US005468079A

United States Patent [19]

Murakoshi et al.

[11] Patent Number: 5,468,079

[45] Date of Patent: Nov. 21, 1995

[54] PRINTER FOR PRINTING ON CARDS

[75] Inventors: Keiji Murakoshi; Mitsuhiko Nebashi; Makoto Ikegami; Noboru Otsuki, all of Suwa, Japan

[73] Assignee: Seiko Epson Corporation, Japan

[21] Appl. No.: 190,749

[22] Filed: Feb. 1, 1994

[30] Foreign Application Priority Data

Feb. 4, 1993 [JP] Japan ..... 5-017713
May 21, 1993 [JP] Japan ..... 5-120146

[51] Int. Cl.[6] ..... B41J 13/10

[52] U.S. Cl. ..... 400/521; 400/525; 400/320; 400/622

[58] Field of Search ..... 400/120.01, 120.16, 400/521, 524, 525, 527, 527.1, 527.2, 528, 529, 530, 535, 537, 542, 543, 320, 622

[56] References Cited

U.S. PATENT DOCUMENTS

| | | | |
|---|---|---|---|
| 3,615,089 | 5/1969 | Laughlin | 400/537 |
| 4,058,056 | 11/1977 | Rubin . | |
| 4,795,285 | 1/1989 | Moriya et al. | 400/320 |
| 5,289,768 | 3/1994 | Keller | 101/408 |
| 5,326,179 | 7/1994 | Fukai et al. | 400/120 |

FOREIGN PATENT DOCUMENTS

| | | | |
|---|---|---|---|
| 0113701 | 7/1984 | European Pat. Off. . | |
| 558419 | 9/1993 | European Pat. Off. | 400/525 |
| 4035970 | 2/1992 | Japan . | |
| 5229199 | 9/1993 | Japan | 400/521 |
| 5229200 | 9/1993 | Japan | 400/521 |
| 5229198 | 9/1993 | Japan | 400/521 |
| 5229197 | 9/1993 | Japan | 400/521 |
| 2165492 | 4/1986 | United Kingdom . | |

*Primary Examiner*—Edgar S. Burr
*Assistant Examiner*—John S. Hilten
*Attorney, Agent, or Firm*—Eric B. Janofsky

[57] ABSTRACT

A printing apparatus comprises a card transport mechanism for printing on a card-like medium. A slider is provided having a card stop against which one edge of the card stops and a holding mechanism holds the card to the slider. A guide frame is further provided having at least one guide portion engaged with the slider for moving the slider parallel to the guide frame. A motor and transmission mechanism moves the slider, whereon a card-like medium is held by the holding mechanism, along the guide member for printing.

33 Claims, 22 Drawing Sheets

PRINTER FOR PRINTING ON CARDS

FIELD OF THE INVENTION

This invention relates generally to a printer for performing validation printing of plural lines on card-type medium or copying paper used, for example, in point-of-sale systems (POS) and electronic cash registers (ECR). Most particularly, the present invention pertains to a printer having a card feed mechanism for printing on cardtype medium.

BACKGROUND OF THE INVENTION

A conventional printer P used generally for performing validation printing is of the kind shown, for example, in FIG. 1. When printing on card-type medium, such a printer is typically provided with a card feed mechanism, examples of which are shown in FIGS. 31 and 32.

FIG. 31 is a side view of a first example of a conventional card feed mechanism. In this type of card feed mechanism rotational energy of a card transport motor 6 is transferred to a card transport roller 301 via card transport power transmission gear train 10. A card presser roller 304 is axially mounted at one end of a card holder lever 303. Card holder lever 303 is pivotly mounted to the printer at pivot 303*a* and is biased by spring 305 in the standby position, as shown in the dotted lines. The other end of card holder lever 303 is coupled with a card presser plunger 302.

Card presser roller 304 is positioned in opposition to the card transport roller 301. The card presser roller 304, which is thus able to swing to attach to the card transport roller 301, is normally separated from the card transport roller 301 as shown by the dotted line while not printing, and is held to attach by the card presser plunger 302.

In operation, card 100 is inserted from above through the gap between print head 2 and platen 25, and then between card transport roller 301 and card presser roller 304 until it stops against card stop 306. This operation sets card 100 into the printer.

When current is supplied to card presser plunger 302 after inserting card 100, card holder lever 303 is rotated causing card presser roller 304 to move to the position indicated by the solid line against the tension of card holder lever spring 305. Card 100 is thus pressed between card transport roller 301 and card presser roller 304. Card transport motor 6 is then driven to transport card 100 to the specified position utilizing the frictional force between the two rollers 301, 304 and the card 100, and then printing is performed by print head 2.

After the printing one line, card transport motor 6 is again driven to advance card 100 to the next print position, and the card printing proceeds as described above. This cycle is repeated until the last line has been printed. When printing is finished, the current supply to card presser plunger 302 is interrupted, thus allowing card holder lever spring 305 to return card holder lever 303 and card presser roller 304 to the standby position (dotted line in FIG. 31). Card 100 can now be removed, and the card printing operation is completed.

FIG. 32 illustrates a simplified side view of a second example of a conventional card feed mechanism. In this example, only the feed mechanism is shown and the print mechanism is not shown. As shown therein, a card transport roller 323 is coupled to card transport ratchet wheel 327, which roller 324 is rotationally driven intermittently by card transport claw 328, via timing belt 325. Card presser roller 322 is coupled to a card presser plunger 321 and moves in response thereto. A spring 321*a* biases card presser plunger 321 so that card presser roller 322 is disposed in a position illustrated by the solid line. That is, card presser roller 322 is provided at a position opposite to card transport roller 323 and is lifted off card transport roller 323 by spring 321*a* during the non-printing or standby mode. When current is supplied to card presser plunger 321, card presser roller 322 is moved as indicated by the dot-dot-dash line so that card presser roller 322 is pressed against card transport roller 323.

In operation, card 100 is inserted into the printer from above. The presence of card 100 is detected by a detector (not shown) and current is then supplied to card presser plunger 321. As a result, card presser roller 322 moves in the direction of the arrow from the standby position indicated by the solid line to the position indicated by the dot-dot-dash line. Card 100 is thus held between card transport roller 323 and card presser roller 322. Card 100 is transported to the specified position for printing by the frictional contact of card 100 with card transport roller 323 and card presser roller 322.

During printing card 100 is fed to an appropriate position for printing by an intermittent feed technique using card transport claw 328 which is described briefly below. In this mechanism, card transport lever 329 is driven rotationally in the direction of arrow x and then in the opposite direction at a specified timing in accordance with a cam not shown in the figure. Card transport trigger lever 331 is engaged with card transport lever channel 329*a* during standby mode, thus preventing card transport lever 329 from turning in the direction of arrow z. When a "feed paper" command is received, current is supplied to card transport electromagnet 330, thus displacing card transport trigger lever 331 in the direction of arrow y to separate card transport trigger lever 331 from card transport lever channel 329*a*. Card transport lever 329 is controlled by the cam as it is turned in the direction of arrow z by the tension of card transport spring 332.

Card transport claw 328, which is provided on card transport lever 329 in a manner allowing claw 328 to pivot, drives card transport ratchet wheel 327 one step. Card transport lever 329 is then rotated in the direction of arrow x by the cam, and card transport trigger lever 331 drops into card transport lever channel 329*a*, thus locking card transport lever 329 and completing the card transport operation for card 100.

Such conventional card feed mechanisms have a number of disadvantages, problems and/or deficiencies as explained in detail hereinbelow.

More specifically, when multiple-layer printing forms are used, the top and bottom layers often slip out of position as the form is transported. This occurs because the rotational friction of the card presser roller is larger than the friction between the layers of the form, thus making it very difficult or impossible to print at the specified printing position throughout the layers.

The inventors have also observed that it appears to be impossible to eliminate a non-printing area in the vicinity of the top or bottom edge of the printing form. This non-printing area is a little wider than the radius of the card transport roller if the card transport roller is provided under or upper the print head. Though the problem can be solved by a structure which has two card transport means at both under and upper area of the print head, the structure is not suitable for POS and ECR printers because of its large size and high cost.

It is difficult to reduce overall printer assembly size because a large power supply is required to supply sufficient electrical power for the card presser plunger to generate sufficient force for the card presser roller to hold the card without slipping between the card and the rollers when the card is pulled by hand or other external force. Because of this factor also, such conventional mechanisms are not suitable for POS and ECR printers.

In the conventional printers as discussed above, printing forms or cards must be inserted to the card stop manually. In this arrangement it is very difficult to handle or print the cards or forms if the depth of the card stop is larger than the length of the cards or forms.

Additionally, the control circuit for the conventional printer is made more complex and expensive because it is necessary to control both the means for transporting the printing card and the card presser means for pressing the card to the card transport roller.

Finally, it is not possible to provide a combined card transport and presser unit because the card transport mechanism and the card presser mechanism are separated by the card. This increases the number of final assembly steps and unit cost.

OBJECTS OF THE INVENTION

It is accordingly the primary object of the present invention to obviate the aforementioned problems.

It is a further object of the invention to provide a printer with a card feed mechanism which is simpler and less expensive to manufacture than conventional printers.

It is another object of the invention to provide a printer with a card feed mechanism for reliably printing on multiple-layer or multiple-part forms.

It is a still further object of the invention to provide a printer with a card feed mechanism which is especially suitable for point-of-sale systems and electronic cash registers.

It is yet another object of the invention to provide a highly reliable, durable printer that is free of changes in the card transport pitch, can print to cards that are small enough to enter all the way into the printer.

It is still yet an additional object of the present invention to provide a printer having a smaller power supply.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

SUMMARY OF THE INVENTION

According to the present invention, a printing apparatus is provided for printing on a card-like medium. A slider is provided having a card stop against which one edge of the card stops and holding mechanism holds the card to the slider. A guide frame is further provided having at least one guide portion engaged with the slider for moving the slider parallel to the guide frame. A motor and transmission mechanism moves the slider, whereon a card-like medium is held by the holding mechanism, along the guide member for printing.

The holding mechanism comprises at least one holding member for holding the card. Each holding member comprises a fixed holding member positioned on the slider, and a moving holding member positioned on the card holder lever, which is installed on the slider to enable rotation and is pushed in the direction holding the card.

The transport drive means comprises a stepping motor, a timing belt installed in the direction of slider movement, and a card transport drive pin engaged with the card holder lever for moving the slider by way of the card holder lever. A detector is arranged within the range of slider movement for detecting a reference position of the slider. A stop for restricting the range of slider movement is provided on the guide frame so that after slider movement is limited and stopped by the stop, the card holder lever is turned by the card transport drive pin to release the pressure of the moving holding member.

In addition, a guide member is provided on a guide frame parallel to the direction of slider movement. An engaging member is provided on the slider traveling along the guide member, and a slider presser lever forcing the engaging member to the guide member across the range of slider movement is provided so that the card stop is movable and is held approximately perpendicular to the direction of movement.

The transport drive means comprises a gear assembly comprising a rack on the slider and gears engaged with the rack and turning in only one direction, and a spring urges the slider in the other direction. After the slider is driven by the gears to the specified position, the slider is returned by fie spring.

Rotation of the gear assembly is controlled by means of a clutch gear positioned to enable rotation on the drive axis of the printer A clutch spring is provided having one end engaged with the clutch gear and the other end engaged with the gear assembly. A trigger magnet comprises an operating plate for stopping gear assembly rotation by engaging with the clutch gear.

In accordance with a further aspect of the present invention, the printer further comprises a cam provided on the gear assembly. The card holder lever is positioned to be able to contact the cam such that opening and closing of the holding means can be controlled by rotating the gear assembly in one direction. In this configuration to reopen the card holder lever, the gear assembly is further rotated, preferably almost another revolution, in the same direction.

In accordance with an additional aspect of the present invention, the printer further comprises a flexible guide member of which one end is attached to the guide frame, the free end of which is positioned between the slider and guide frame, and which opens and closes with movement, of the slider such that when the slider is positioned at the farthest point from the print means, the free end opens to guide the card paper.

In a printer according to the present invention as thus described, the card to be printed to is held in a slider that travels along a guide frame, thus causing the recording medium, i.e. the card to move relative to the print means while held in the slider. The card holder lever applying pressure to the card rotates according to the position of the slider. Accordingly, there are two slider positions. (1): where the card holder lever turns and the card can be set or removed, and (2) where the card holder lever applies pressure to hold the card. The card can thus be moved while holding and released for setting or removing by simply controlling the position of the slider.

Because the drive shaft driven by the printer assembly, the clutch means, the trigger magnet which operates the clutch, and the cam and gears driven by the clutch are also disposed, the drive torque can be selectively applied to drive the rack provided on the slider and thus moving the slider, which is pulled toward the standby position to reset by the spring. The card holder lever is turned by a cam controlled by the trigger magnet, thus enabling the cards to be set or removed and held in the printer.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference characters denote similar elements throughout the several views.

DESCRIPTION OF THE PREFERRED EMBODIMENT

THE FIRST EMBODIMENT

Figure 1:
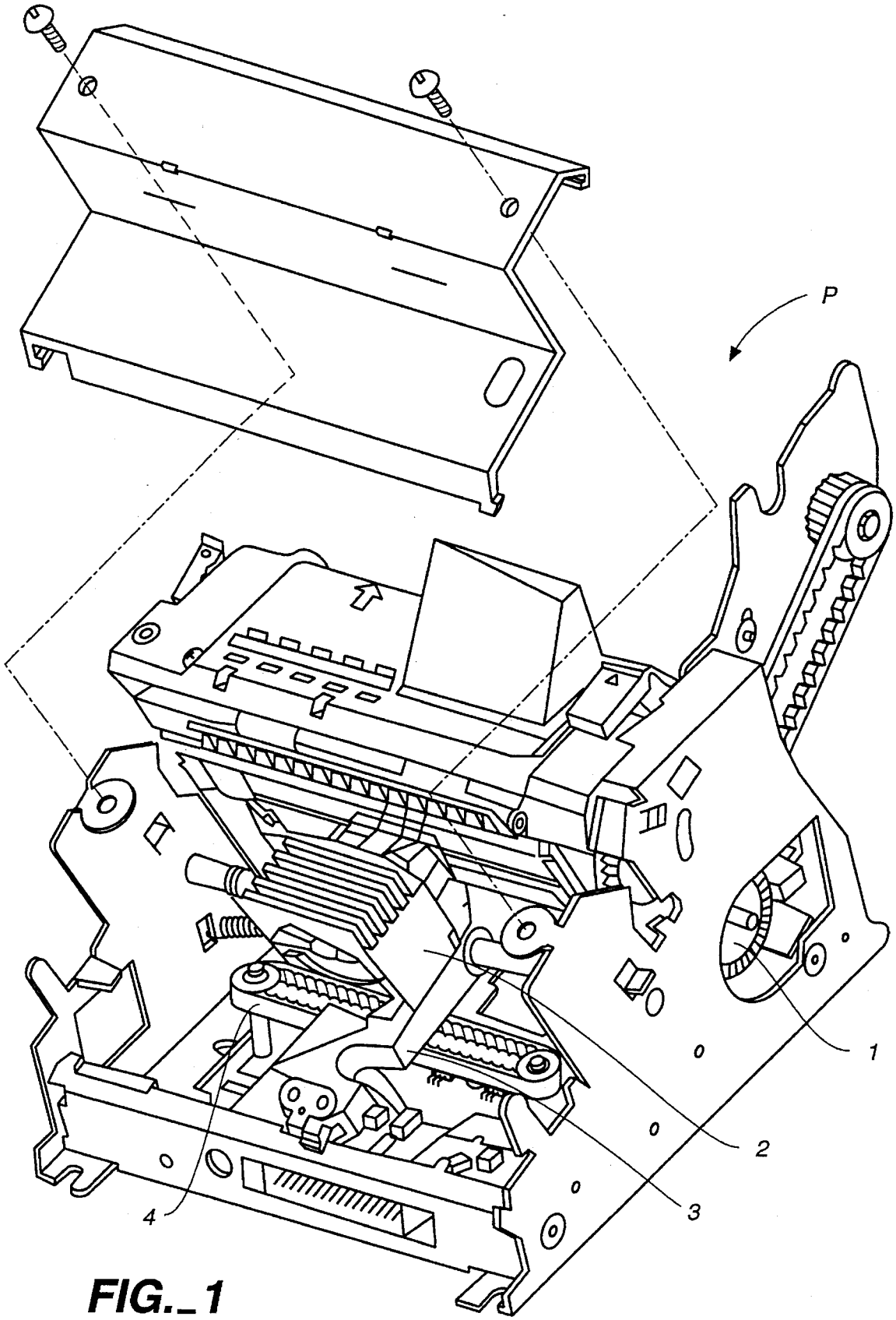
FIG. 1 is a perspective view of a printer constructed in accordance with a first embodiment of the present invention.
Figure 30:
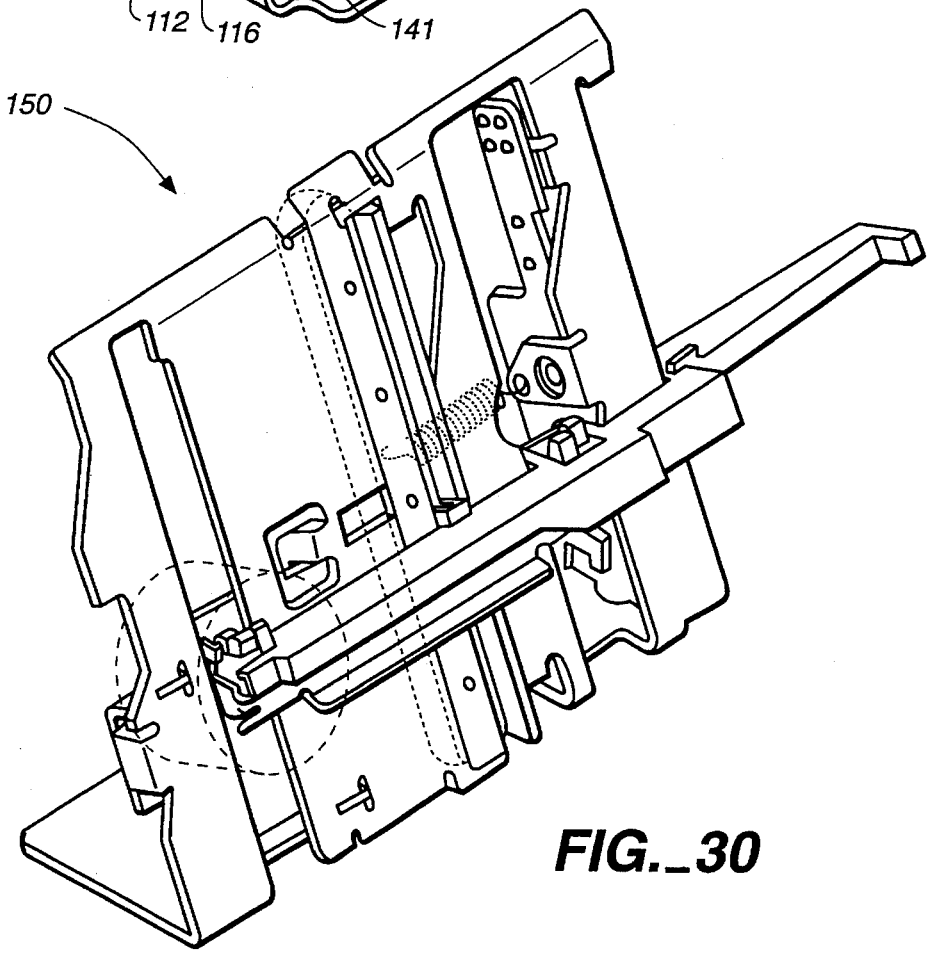
FIG. 30 is a rear perspective external view of the card transport mechanism of the first embodiment.
Figure 31:
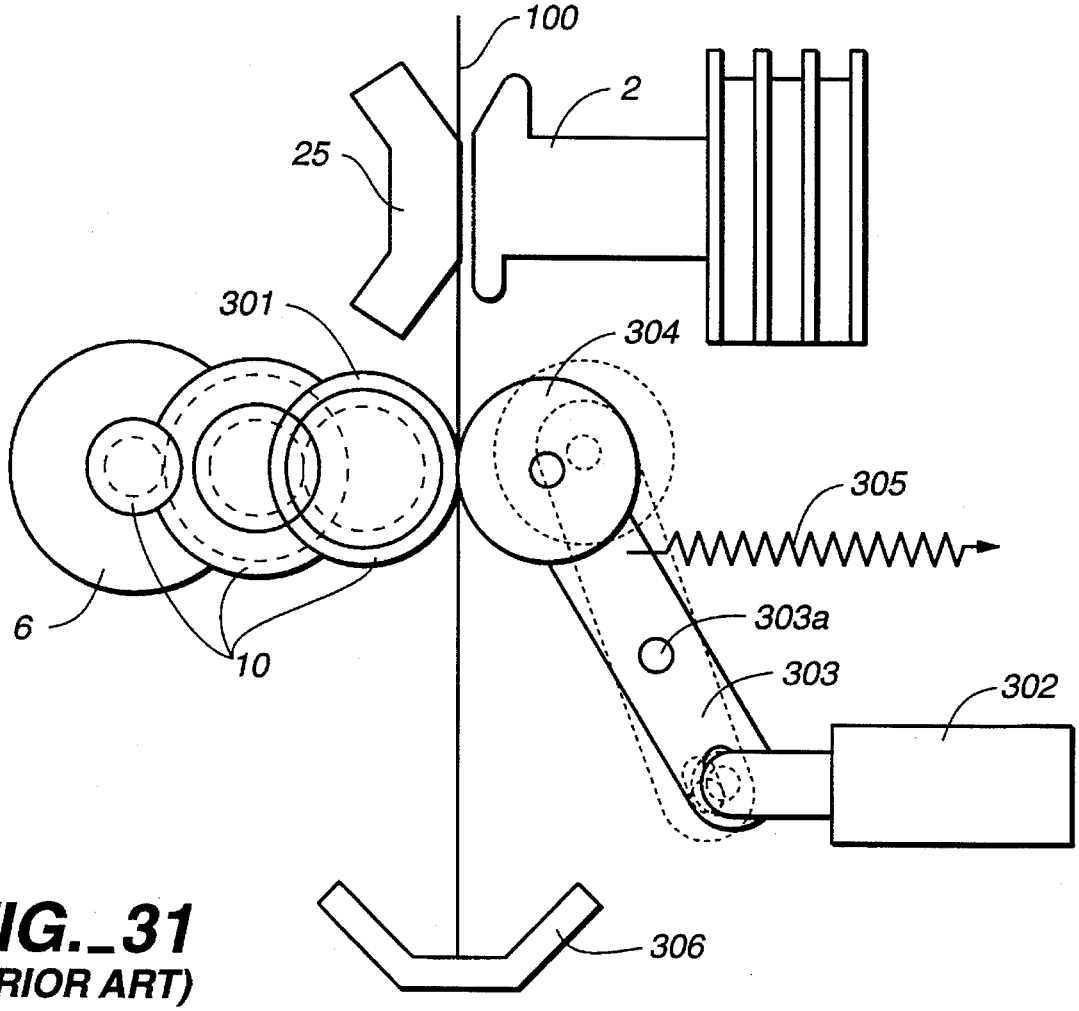
FIG. 31 (PRIOR ART)
FIG. 31 is a side view of a conventional card feed mechanism.
Figure 32:
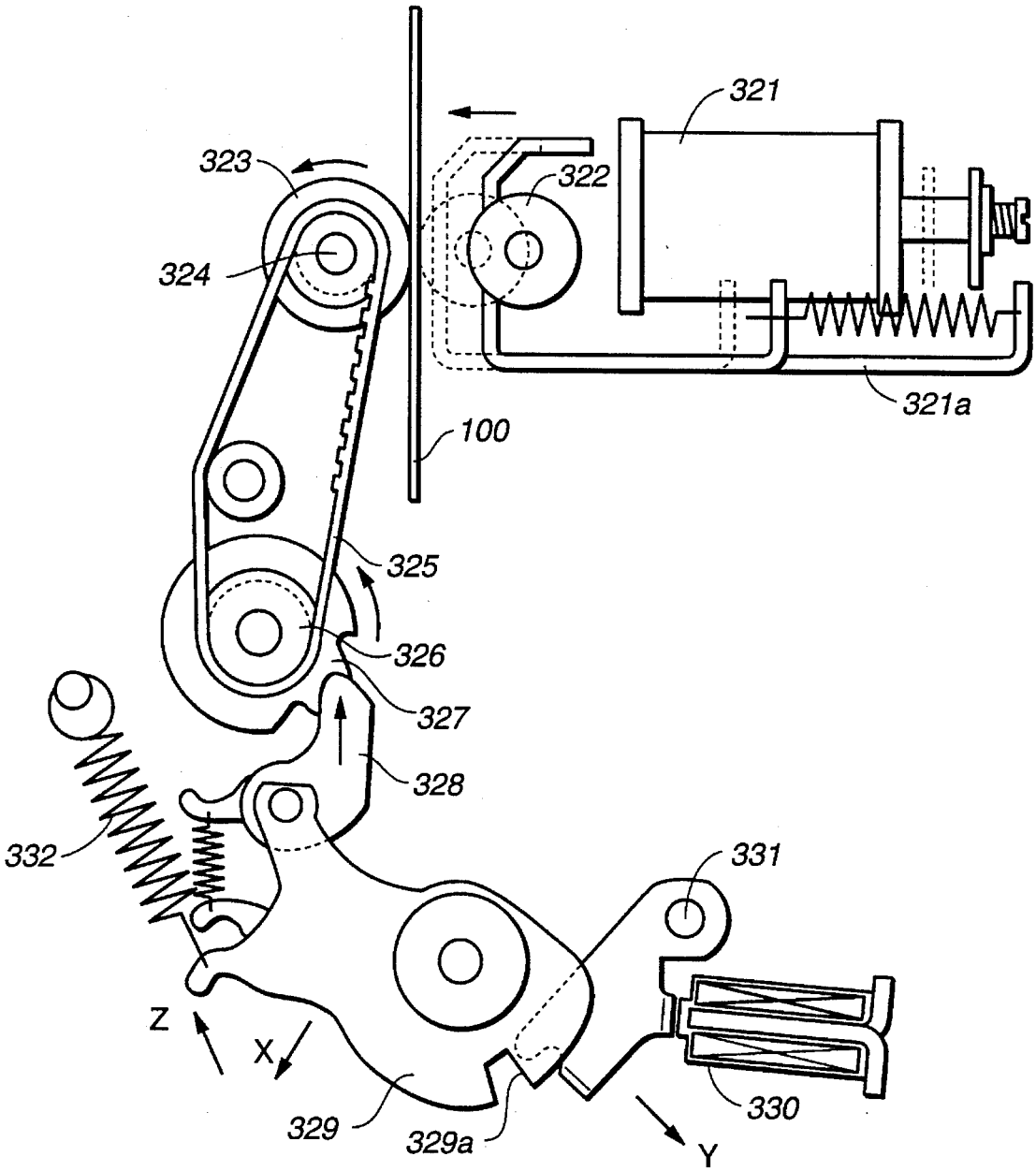
FIG. 32 (PRIOR ART)
FIG. 32 is a side view of another conventional card feed mechanism.

The first embodiment of a printer in accordance with the present invention is described below with reference to FIGS. 1 to 14 and 30. FIG. 1 is a front perspective view of a printer and FIG. 30 is a rear perspective external view of a card transport mechanism according to the invention.

Figure 2:
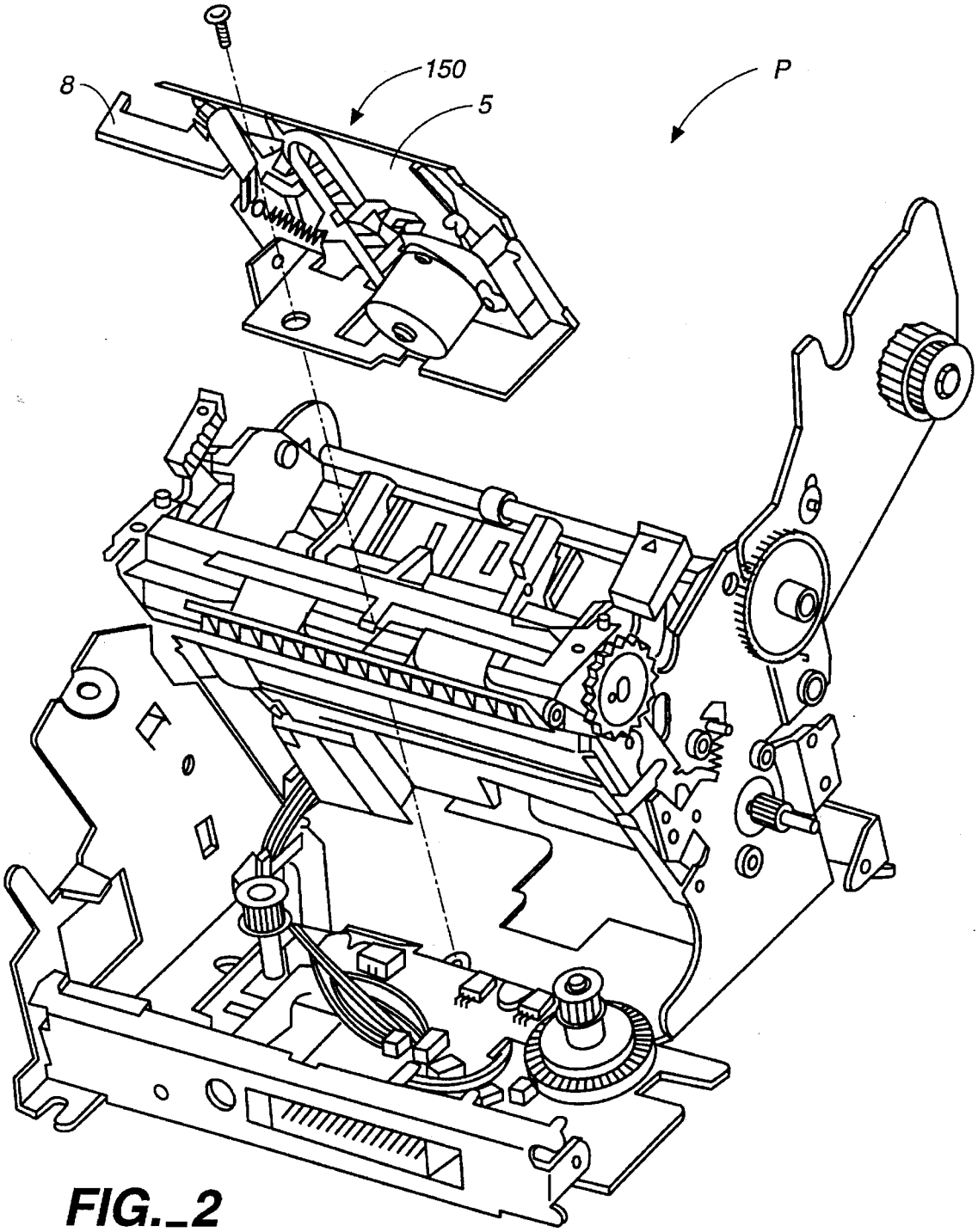
FIG. 2 is a perspective view of the printer in FIG. 1 comprising a card transport mechanism constructed in accordance with the first embodiment of the present invention.

The printer shown in FIG. 1 is, for example, a point-of-sale (POS) printer, generally referred to as P, which can print receipt papers and journal papers. 0f course, as will be appreciated by one of ordinary skill in the art, other types of printers may be used to implement the present invention. As shown in FIG. 2, the printer P is designed to be optionally equipped with a card transport mechanism 150 described in detail below so that the printer can also print on card type printing media. Of course, the printer P can also selectively print on rolled paper. As noted above, printer P incorporating the card transport mechanism can be implemented by any type of conventional printer. As such, a detailed explanation of printer P will be omitted.

Referring specifically to FIG. 1, printer P comprises a motor 1 for generating a drive force in response to an electrical signal from a controller (not shown) to drive carriage drive belt set 4 rotationally by means of a gear train. The printer P as comprises a printhead 2 mounted on a carriage 3. Print head 2 may be implemented as any conventional print head, such as an impact print head, ink jet print head or the like. Carriage 3 is operatively engaged with carriage drive belt set 4 and is driven perpendicular to the direction of roll paper transport. As will be understood, a line is printed on the output media as print head 2 is transport across the media by carriage 3.

Turning now to FIG. 2, printer P is shown having card transport mechanism 5 mounted thereon in accordance with the first embodiment of the present invention installed to the printer. Referring to FIGS. 4–7, card transport mechanism 5 comprises a card transport power transmission assembly 200, a card transport assembly 201, a card presser or holder assembly 202, and a card transport position detector assembly 203. Detailed descriptions of each of these assemblies are presented hereinbelow.

Figure 8:
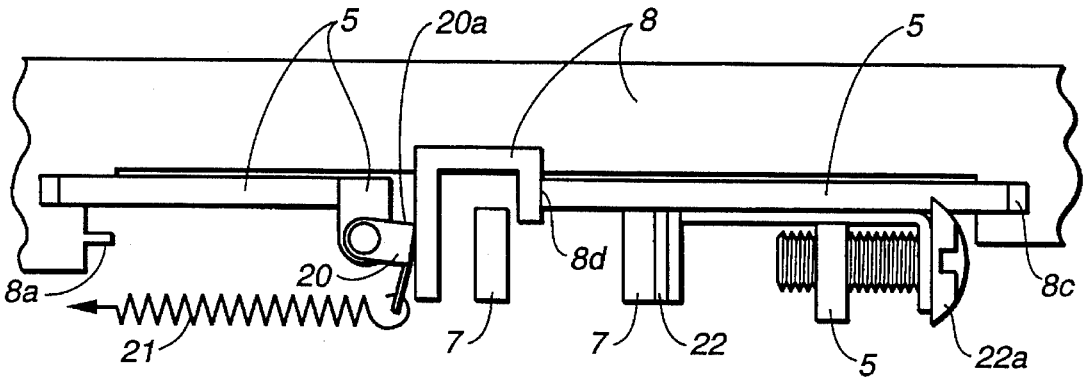
FIG. 8 is an enlarged partial top view of the means holding the card transport mechanism of FIG. 2.
Figure 9:
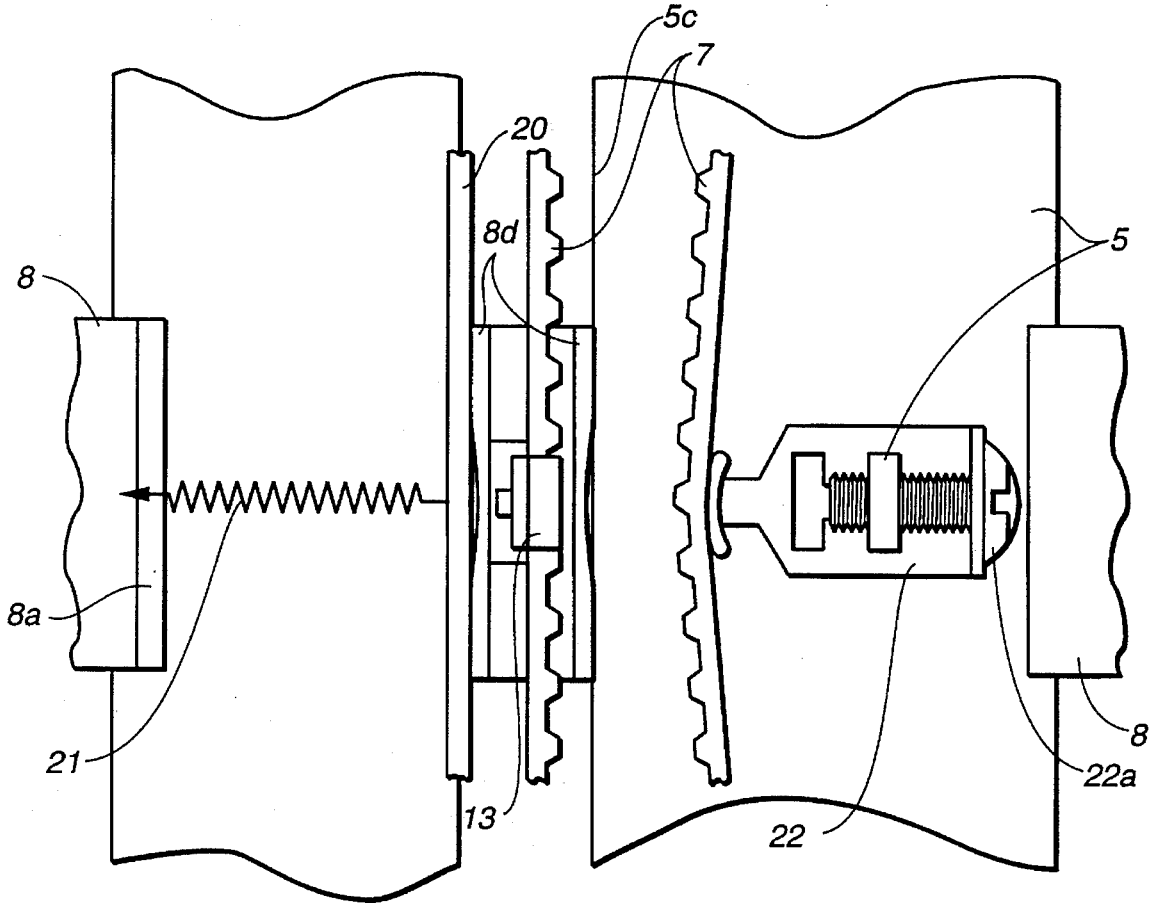
FIG. 9 is a partial front view of the card transport mechanism of FIG. 2.
Figure 12:
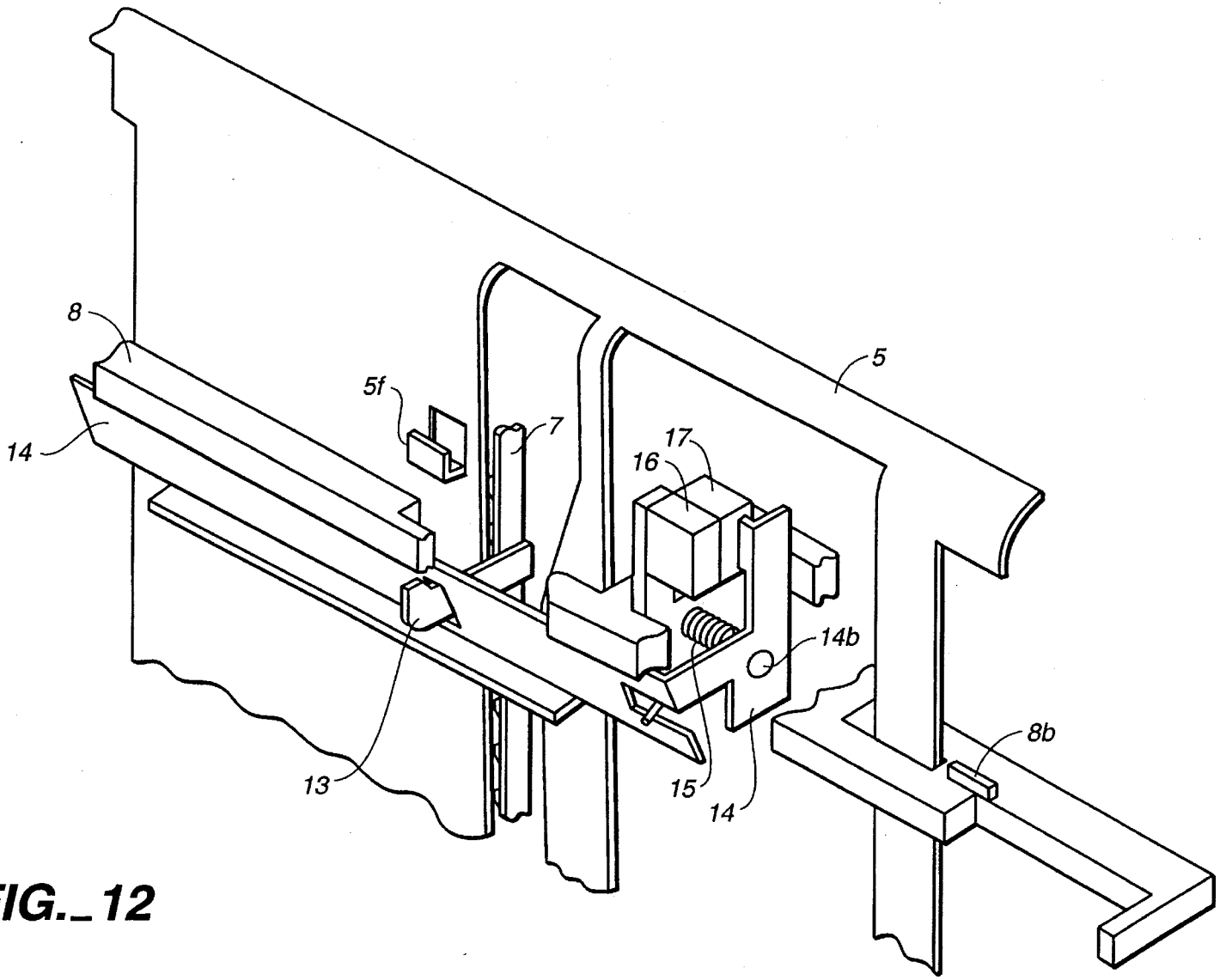
FIG. 12 is a partial rear perspective view of the card transport mechanism of an alternate first embodiment.

Card transport mechanism 150 comprises a guide frame 5 and a slider 8. Referring to FIGS. 8, 9 and 12, channels 8c formed on both sides of slider 8 and slidably engage with opening formed in guide frame 5 so that slider 8 can be moved along guide frame 5 in a direction substantially parallel to guide frame 5. As is explained hereinbelow, when card 100 placed in the card transport mechanism 150, the card is disposed on slider 8, and the movement of slider 8 positions card 100 relative to print head 3 for printing.

In the preferred embodiment, card transport mechanism 150 is positioned below print head 2, and is fastened to the main printer frame by, for example, screws (not shown).

Figure 3:
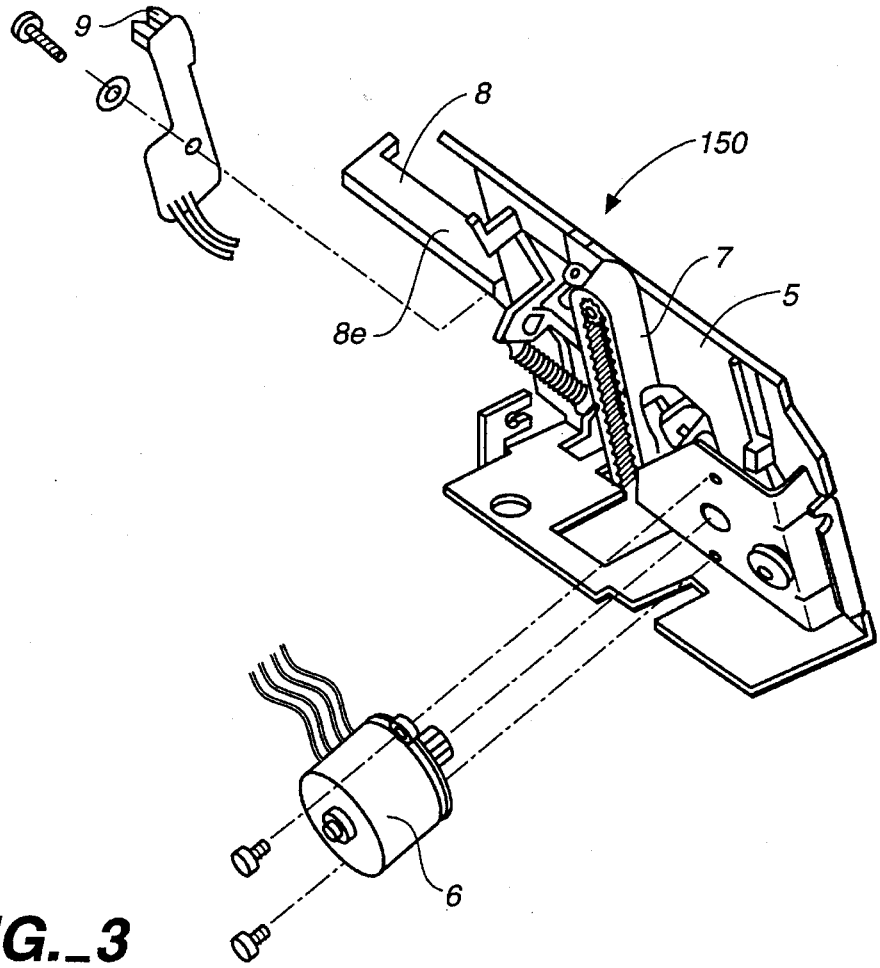
FIG. 3 is a front perspective, partial view of the card transport mechanism of FIG. 2.
Figure 4:
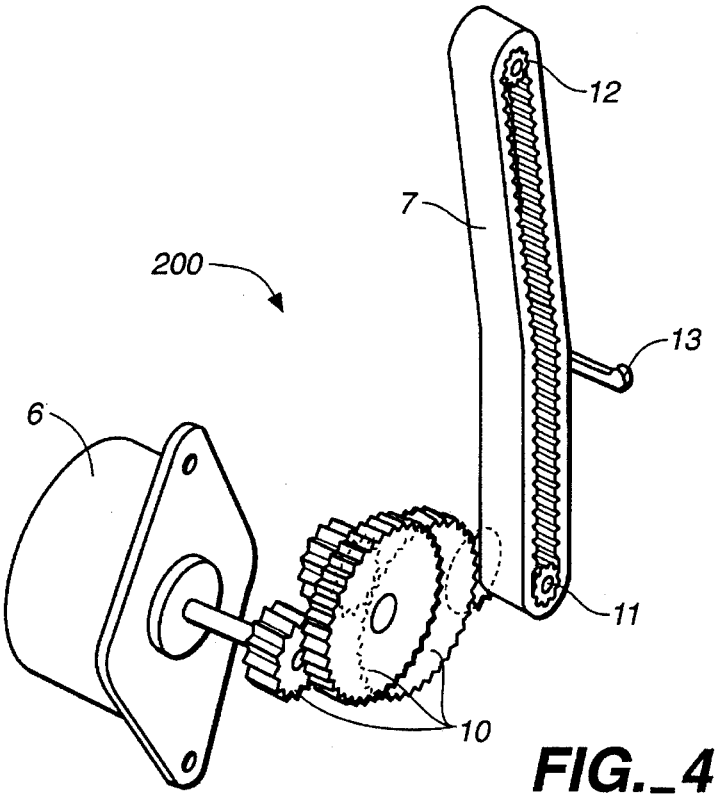
FIG. 4 is perspective view of the card transport power transmission assembly of the card transport mechanism of FIG. 2.

FIG. 3 is a perspective front view of the card transport mechanism 150, and FIG. 4 illustrates card transport power transmission assembly 200. In the preferred embodiment, card transport motor 6 is a stepping motor for generating the appropriate card transport force, and can be driven in both forward and reverse directions. Rotation of card transport motor 6 is transferred by means of a card transport force transmission gear train 10 to belt drive pulley 11. Belt drive pulley 11 is also coupled to card transport belt; 7 for transferring the rotational energy of motor 6 thereto. Card transport belt 7 is preferably a timing belt to which card transport drive pin 13 is affixed thereto, and is arranged between belt drive pulley 11 and belt idler pulley 12. Card transport belt 7 is coupled to slider 8 via card holder lever 14 and travels in the same direction thereof, as is explained in detail hereinbelow.

Turning now to FIG. 12, slider 8 comprises card holder lever 14 which is rotatably engaged thereto. Card holder springs 15, preferably torsion coil springs, are provided, each having one arm engaging an end of slider 8 and the other arm engaging a corresponding portion of card holder lever 14 for biasing card holder lever 14 toward slider 8. Card holder lever 14 also engages card transport drive pin 13 so that as timing belt 7 is displaced in response to motor 6, slider 8 is correspondingly displaced. Thus, slider 8 is driven integrally with card transport belt 7. As will be explained below, holder lever 14 can be set to either the open position for accepting or releasing card 100 or the closed position for holding card 100 in card transport mechanism 150.

Figure 5:
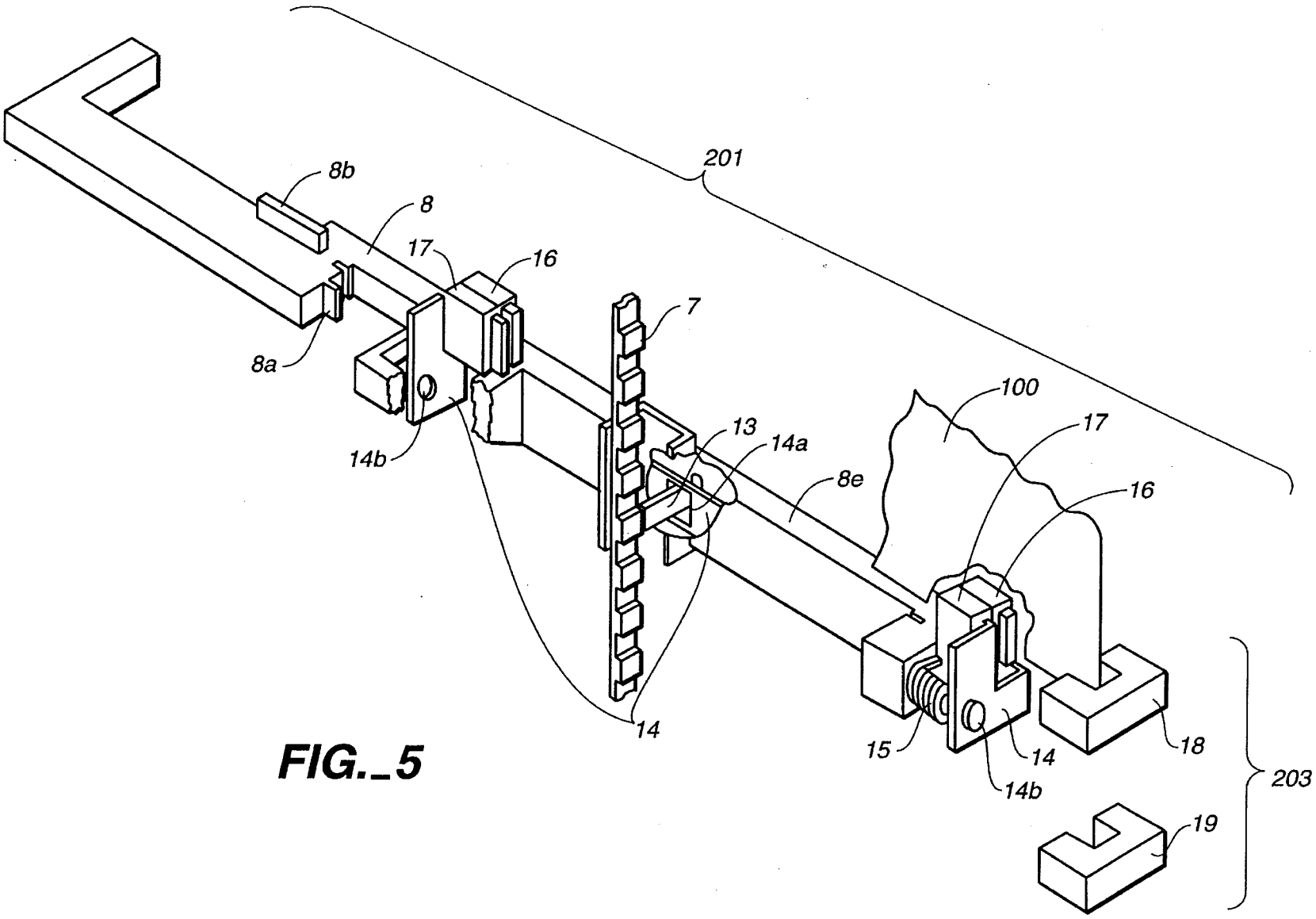
FIG. 5 is a perspective view of the card holding mechanism of the card transport mechanism of FIG. 2.

Referring to FIG. 5, slider 8 comprises card stop **8*e*, against which the bottom edge of card 100 is abutted thereto when placed in the card transport mechanism. In this manner, when slider 8 is displaced, card 100 is appropriately positioned opposite printer head 2** for printing.

As shown in FIG. 5, slider 8 comprises two sets of holding members 16 and 17. Holding members 17 are arranged at respective ends of card stop **8*e*, and holding members 16 are arranged at respective ends of lever 14. Holder members 16 and 17 are preferably comprised of a rubber-like material to frictionally hold card 100 when lever 14 is in the closed position. As noted above, when lever 14 is in the closed position, spring 15 biases lever 14 toward slider 8 so that holding members 17 press card 100 against holding members 16 to hold card 100 in card transport mechanism 150**.

Card transport mechanism 150 contains various detectors to determine the position and/or presence of slider 8 or card 100. More specifically, card transport mechanism 150 comprises a slider position detector 9 for ascertaining the position of slider 8. Slider position detector 9 is presently implemented as a light-transmitting sensor. As shown in FIG. 5, slider 8 comprises a tab **8*a*. When slider 8 is raised to its upward most position, tab 8*a* interrupts the light impinging detector 9 so as to detect the position of slider 8**.

Also shown in FIG. 5, the card transport further includes card detectors 18 and 19 for detecting a first or an upper position and a second or a lower position of card 100, respectively. Similarly, card detectors 18 and 19 comprise as photodetectors. The position of card 100 is determined when card 100 interrupts light in either of detectors 18 or 19. Of course, as will be appreciated by one of ordinary skill in the art, other types of position sensors may be employed in lieu of photodetectors 9, 18 and 19.

Figure 6:
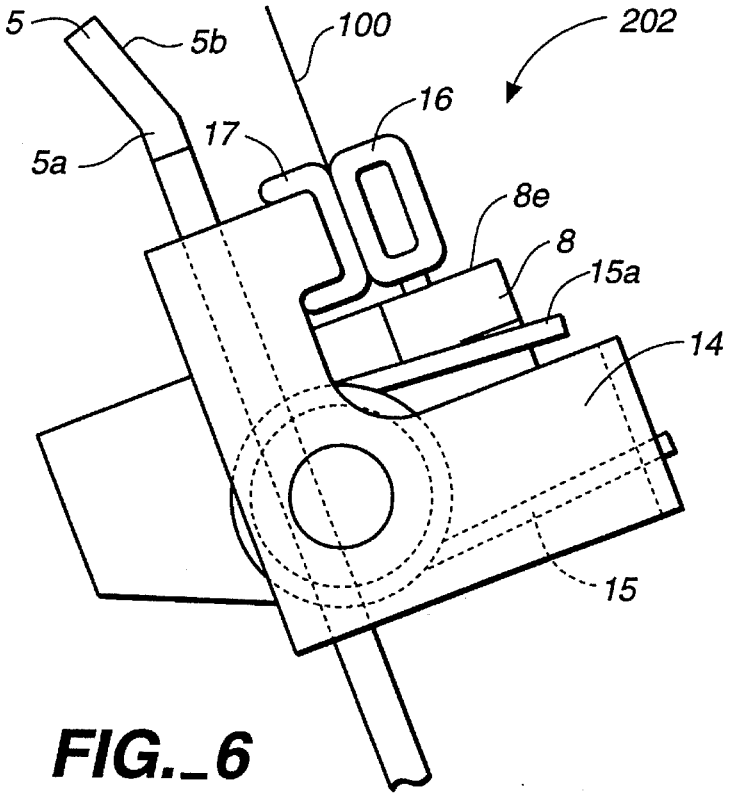
FIG. 6 is a side view illustrating a card presser assembly of the card transport mechanism of FIG. 2 in the dosed position for holding a card.
Figure 7:
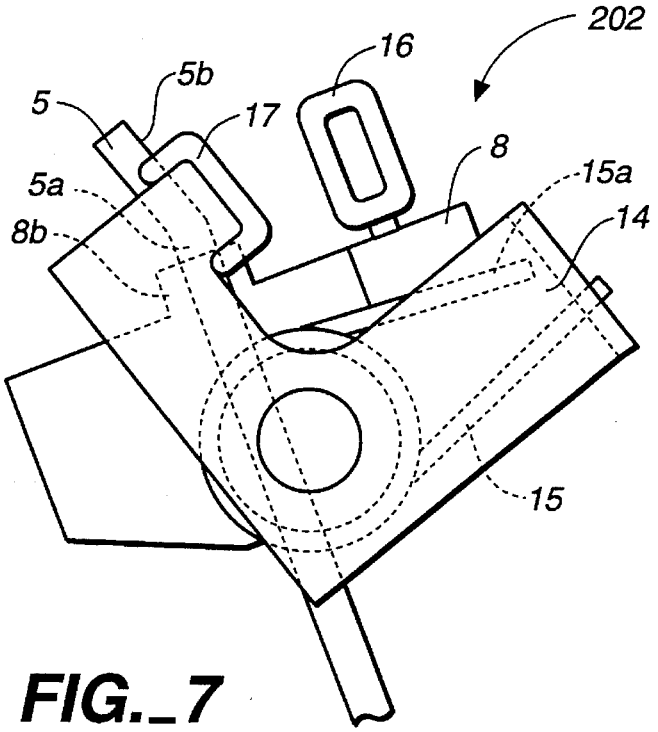
FIG. 7 is a side view illustrating a card presser assembly of the card transport mechanism of FIG. 2 in the open position for accepting or releasing an inserted card.

FIG. 6 is a side view illustrating holding lever 14 in the closed position for holding card 100. The holding lever 14, slider 8 and associated components will now be referred to as card presser or holder assembly 202. FIG. 7 is a side view showing card holder assembly 202 in the open position for accepting or releasing card 100. FIG. 8 is an enlarged partial top view of the means for holding the slider 8 to the guide frame 5, and FIG. 9 is a rear view of FIG. 8.

Card transport mechanism 150 further includes a slider guide lever 20. Both sides of slider guide lever 20 are connected to guide frame 5 in a manner enabling slider guide lever 20 to pivot. A slider guide spring 21 is installed in tension between slider guide lever 20 and guide frame 5, and applies pressure in the direction forcing the abutting section of slider 8 to guide portion **5*c* of guide frame 5. As shown in FIG. 9, the card transport mechanism comprises a belt tension lever 22 for applying tension to card transport belt 7. The applied tension may be adjusted by, for example, means of a screw arrangement 22*a*. As noted above, channels 8*c* formed on both sides of slider 8 engage slidably and cover guide frame 5 so that slider 8 can slide along guide frame 5**.

Referring again to FIG. 8, slider 8 comprises a tab portion **8*d*. By the action of slider presser spring 21, tab portion 8*d* of slider 8 is pushed against guide portion 5*c* of guide frame 5 by means of slider presser lever 20, and slider 8 is thus mounted to guide frame 5 without rocking and in a manner enabling slider 8 to keep approximately perpendicular to the direction of card transfer throughout the slide motion. Note that the guide portion 5*c*, more specifically a sliding part of guide frame 5, and the abutting part 20*a*, namely a sliding part of slider presser lever 20**, have a reduced coefficient of friction, thereby stabilizing the card transport operation. The reduction in the coefficient of friction is accomplished by, for example, finishing the guide and abutting portions to a mirror-like surface.

As shown in detail in FIG. 9, tab portion **8*d* of slider 8 is so formed as to contact the guide portion 5*c* of the guide frame 5 at only two points, namely at top and bottom along the slide direction. In the preferred embodiment, tab portion 8***d* does not contact in the center area as shown in FIG. 9 and the distance between the contact points is preferably as large as possible. As a result of this construction slider 8 is able to slide stably along the guide frame in a substantially perpendicular direction and preventing slider 8 from slanting or deviating from the perpendicular direction. Referring again to FIG. 9, slider 8 and slider presser lever 20 also contact at two points. The tension of slider presser spring 21 is set sufficient enough to prevent slider 8 from slanting when external pressure is applied to card 100 during printing.

Figure 11:
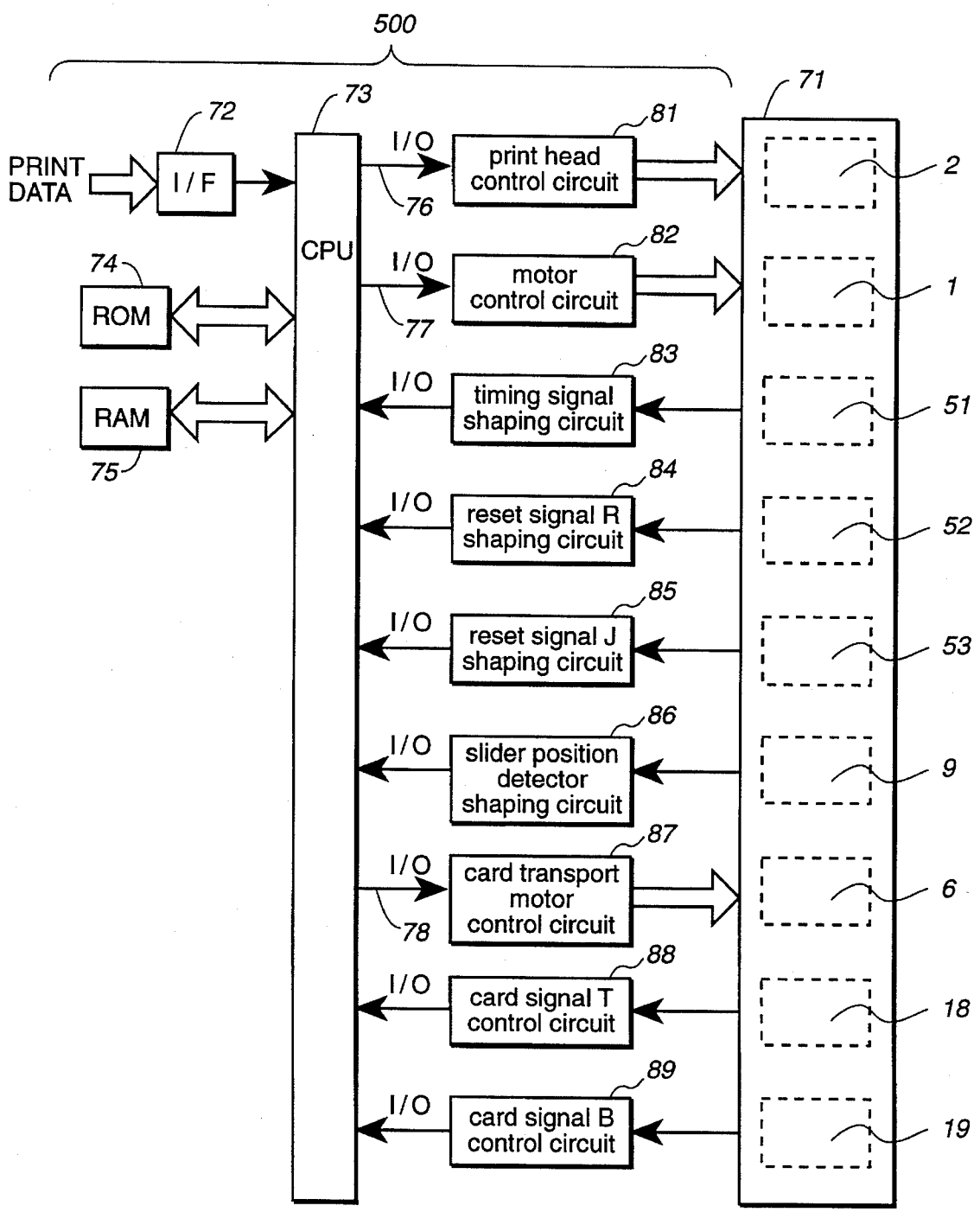
FIG. 11 is a block diagram of the overall configuration of a printer according to the first embodiment of the present invention.

FIG. 11 is a block diagram of the overall configuration of a printer system in accordance with the present invention. The printer system includes a control circuit 500 and a printer mechanism 71 according to the first embodiment of the invention. The printer mechanism comprises print head 2, motor 1, card transport motor 6, timing pulse generator 51 for generating the print timing for print head 2, reset pulse generator 52 for generating a reset pulse R and reset pulse generator 53 for detecting the position of print head 2 and for generating a reset signal J, slider position detector 9, card detector 18 for generating a position signal T, and card detector 19 for generating a card detection signal B. Note also that timing pulse generator 51, reset pulse generator 52, and reset pulse generator J 53 are only shown in this figure.

The elements outside outline 71 constitute the control circuit 500 for the printer mechanism of the present embodiment. Of course, while the circuit of FIG. 11 is preferred, persons of ordinary skill in the art who have read this description will recognize that various modifications and changes may be made therein. Control circuit 500 comprises a central processing unit (CPU) 73 or controller which may be implemented by a microprocessor. CPU 73 is connected to print head control circuit 81, motor control circuit 82, and card transport motor control circuit 87, as well as interface 72, read only memory (ROM) 74, and random access memory (RAM) 75. The interface circuit 72 is also connected to an external device (not shown) such as an electronic cash register, point-of-sale device, computer or the like. Generally speaking, interface circuit 72 receives print data from the external device and provides the data to CPU 73. Additionally, interface circuit 73 provides status and control signals from CPU 73 to the external device. ROM 74 typically stores preprogrammed instructions for controlling the printer, and RAM 75 typically stores the data waiting to be printed and the preprogrammed instructions awaiting execution by CPU 73.

Print head control signal 76, motor control signal 77, and card transport motor control signal 78 are output from CPU 73 to print head control circuit 81, motor control circuit 82, and card transport motor control circuit 87, respectively, in accordance with the print data received from interface circuit 72 and the preprogrammed instructions stored in ROM 74.

Control circuit 500 comprises six signal shaping circuits circuit corresponding to individual sensors including timing signal shaping circuit 83, reset signal R shaping circuit 84, reset signal J shaping circuit S4, slider position detector shaping circuit 86, card signal T control circuit and card signal B control circuit. Such circuits are known to one of ordinary skill in the art and their detailed descriptions are omitted from this discussion. Each signal shaping circuit compares an analog input signal with a certain voltage level and outputs a digital signal. Therefore, comparators may be used as the signal shaping circuit. Timing signal shaping circuit 83 shapes the signal generated by timing pulse generator 51, and outputs a timing signal used as the reference signal for controlling the power supply to print head 2 to CPU 73. Reset signal R shaping circuit 84 outputs reset signal R, which is generated by reset pulse generator 52, to CPU 73 indicating printing can be performed when carriage 3 moves to the standby position. Reset signal J shaping circuit 85 outputs reset signal J, which is generated by reset pulse generator 53, to CPU 73 indicating printing can be performed when carriage 3 moves to the standby position. Reset pulse generator 53 and 52 may be, for example, photo-interupters or detectors mounted on both sides of carriage moving path. In this arrangement respective interrupter plates (not shown) fixed to the carriage may be used for the reset pulse generators.

Slider position detection signal shaping circuit 86 shapes the signals from slider position detector 9 to provide an appropriate slider position detection signal required to evaluate whether or not slider 8 is in the standby position (i.e., whether or not card insertion or setting is possible), and outputs it to CPU 73. Card detection signal T shaping circuit 88 shapes a signal from card detector 18 to output card detection signal T to CPU 73 for evaluating whether or not a card presents on the card holder (i.e., whether or not card 100 is set and whether or not card 100 is removed). Card detection signal B shaping circuit 89 shapes a signal obtained from card detector 19 to output card detection signal B to CPU 73 for evaluating whether or not a card is inserted.

The card transport mechanism of the first embodiment of the invention is described next below. First, the operation for setting a state for card insertion is described. The initialization operation described hereafter is first executed when the power is turned on. This process starts by CPU 73 determining whether slider position detector 9 has detected slider position detection tab 8*a* of slider 8 (see FIG. 10) in response to the output of slider position detector signal shaping circuit 86. If slider position detection tab 8*a* is detected, card transport motor 6 (FIG. 4) is driven counterclockwise to move card transport drive pin 13 down, thus moving both slider 8 and card holder lever 14 down to the position where slider 8 is not detected by the detector. As noted hereinabove, the rotation force of motor 6 moves slider 8 and lever 14 since motor 6 is coupled via transmission gearing 10, timing belt 7, card transport drive pin 13 to engaging member 14*a* of card holder lever 14. Otherwise the operation proceeds to the next step as described next.

At this time holding members 16 are pressed against holding members 17, namely the holding members are in the closed position as shown in FIG. 6. Card transport motor 6 (FIG. 4) is then driven clockwise to move the slider up, thus causing slider position detection tab 8*a* to interrupt the light beam of slider position detector 9 as slider 8 enters the slider-detected position. By then driving card transport motor 6 a predetermined number of steps, abutting section 8*b* of slider 8 (FIG. 10), abuts on abutting section 5*a* of guide frame 5, and slider 8 is stopped.

As the motor continues to turns, card transport drive pin 13 fixed to card transport belt 7 pushes card holder lever 14 up, causing card holder lever 14 to rotate on pivots 14*b* against the tension of card presser springs 15.

As card holder lever 14 turns, card holding members 17 fastened to card holder lever 14 are separated from card holding members 16 provided on slider 8. As a result of this operation, the holding members are now in the open position as shown in FIG. 7. At this time card 100 may be inserted in card transport mechanism 150. The transport motor 6 is still energized in order to maintain the holding members in the open position.

The card holding operation, card loading operation, card transport and printing operation, and card release operation executed after card 100 is inserted along guide frame card guide 5*b* (FIG. 6) are described next.

The card holding operation is described first. When card 100 is inserted and stops against slider 8 inside the printer, card detector 18 (FIG. 5) detects the inserted card 100 and card detection signal T shaping circuit 88 (FIG. 11) outputs the signal to CPU 73 indicating the insertion of card 100. At this time card 100 is ready for the printing operation.

In the next step, the holding members 16 and 17 are closed to hold card 100. This is accomplished as follows. CPU 73 outputs card transport motor control signal 78 to card transport motor control circuit 87 to drive card transport motor 6 (FIG. 4) counterclockwise. As card transport drive pin 13 fixed on card transport belt 7 moves down to the prescribed position, the card holder lever 14 is released. As a result, card holder lever 14 is rotated back under the urging of card presser spring 15 so that holding members 17 on card holder lever 14 press card 100 against holding members 16 on slider 8. Card 100 is thus held between card holding members 17 and card holding members 16, as shown in FIG. 6.

Figure 10:
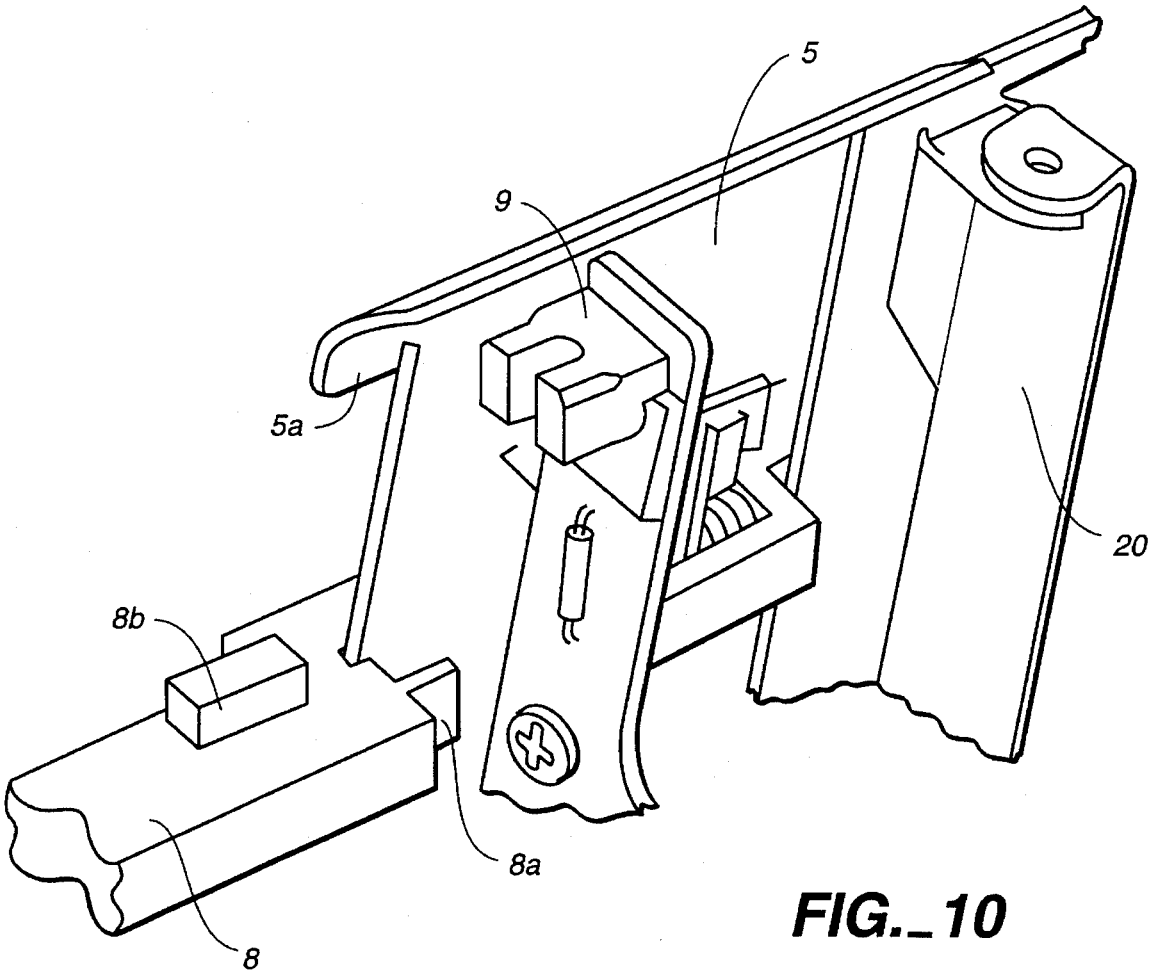
FIG. 10 is a partial front perspective view of the position detection means for detecting the position of the slider of the card transport mechanism of FIG. 2.

While holding card 100, as card transport motor 6 continues to be driven counterclockwise, card transport drive pin 13 lowers slider 8. Slider position detection tab 8*a* is positioned so that the light beam of slider position detector 9 is no longer interrupted (FIG. 10). Card 100 is moved with slider 8 to the printing position of the upper most line by card transport motor 6 which rotates as many steps as required to move the distance to the print position plus M predetermined steps.

The number of steps M specified here is the number of steps required to absorb the recoil of the power transmission system, i.e., the card transport force transmission gear train 10 which is present when the rotational direction of card transport motor 6 is reversed. If card detector 19, which is optionally installed, is arranged at the lower position, as shown in FIG. 5, card 100 will interrupt the light beam of card detector 19 as it is lowered into the printer. Card detection signal B shaping circuit 89 (FIG. 11) then outputs a confirmation signal to CPU 73. In other words, CPU 73 confirms whether or not card 100 still be held by slider 8 and card holder lever 14.

The card print operation with the card transport operation is described next.

After the operation drawing the card into the printer is completed, card transport motor 6 (FIG. 4) is driven M steps clockwise to absorb the recoil of the power transmission system, and card transport motor 6 is still energized to maintain thereafter the card transport mechanism as it is. Note that the card transport belt 7 is maintained under tension by adjusting belt tension lever 22 (FIG. 9) to reduce the recoil. At this time printing is executed by print head control circuit 81 in response to CPU 73 (FIG. 11). After printing for the current line is completed, slider 8 and card 100 are advanced to the next print position. Note that one card advance step is 1/N (where N is a natural number), the vertical dot pitch of print head 2. Thus it possible to print graphical images without having any gaps between lines. The number N is determined by taking the torque of the motor and the load under consideration. Multiple line printing can be executed by repeating above sequence. Note also that printing to the bottom edge of card 100 is possible because the card stop of slider 8 can travel in close proximity to print head 2.

When all the data has been printed, card 100 is released as follows. More specifically card holder lever 14 is operated to open card holding members 16 and 17 as described above. The card transport motor 6 is energized enabling card 100 to be removed similar to the process of that of card insertion. Alternatively, if all the data to be printed to card 100 is written to RAM 75, it is possible to print card 100 in the reverse direction from the bottom line to the top line by pulling card 100 into the printer during the printing operation.

In the first embodiment of the invention as described above, the card holding operation, card loading operation, card transport operation, and card release operation can be easily achieved using only the drive power of the card transport motor. In addition, a card transport unit can be achieved because the entire mechanism is mounted on the guide frame, thus enabling printers to be easily selectively equipped with the card printing function.

In this embodiment card transport drive pin 13 engages card holder lever 14 such that when the power supplied to card transport motor 6 is maintained after slider 8 is stopped by contacting guide frame at stopping section 8*b* of slider 8, card transport drive pin 13 causes card holder lever 14 to rotate to the position enabling card 100 insertion. However, the present invention is not limited to this embodiment. These mechanism and operation concerning the card holder lever can be modified in an alternative configurations including the second embodiment described hereafter.

Figure 14:
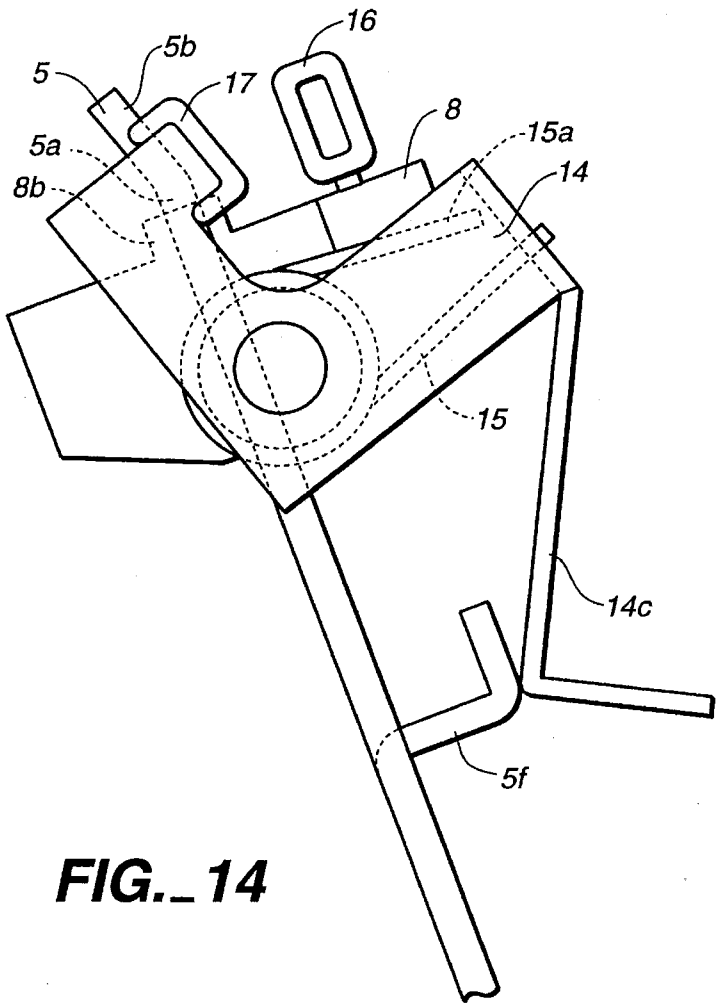
FIG. 14 is a side view illustrating a card presser assembly of the card transport mechanism of FIG. 12 in the open position for accepting or releasing an inserted card.
Figure 13:
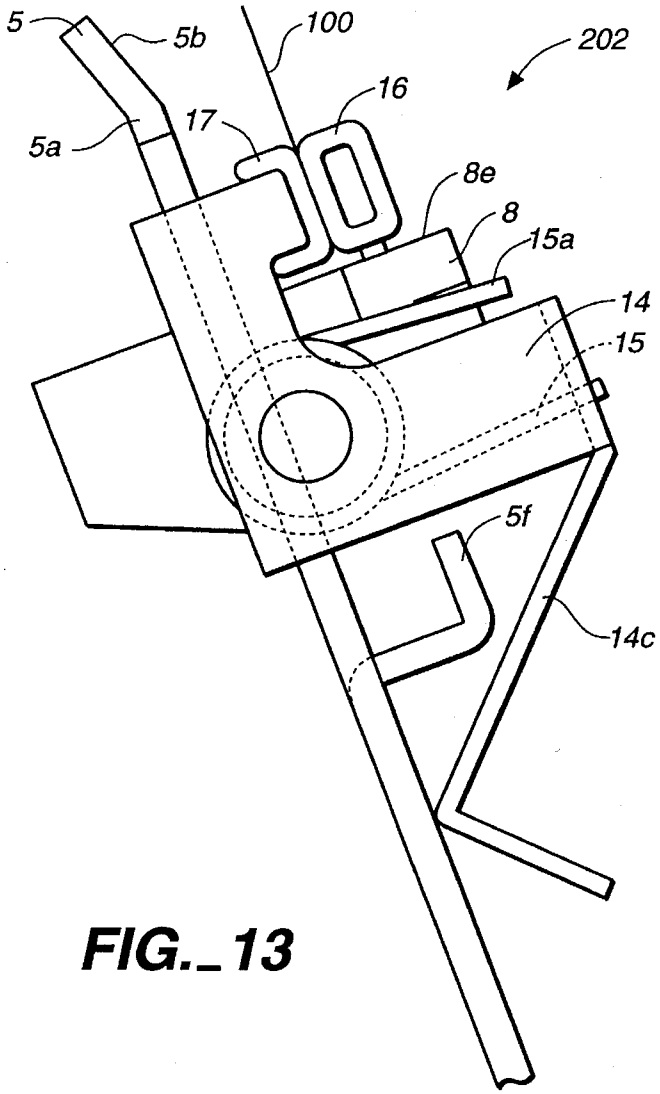
FIG. 13 is a side view illustrating the card presser assembly of the card transport mechanism of FIG. 12 in the closed position for holding a card.

FIG. 12 is a rear perspective view of an alternative first embodiment. A lever drive projection 5*f* is formed on guide frame 5 so that card holder lever 14 is rotatable on pivot section 14*b* as card holder lever 14 passes lever drive projection 5*f*. FIGS. 13 and 14 are partial side sectional views focusing on lever drive projection 5*f* and illustrating the card holder open operation executed by using above explained mechanism. In FIG. 13, card holder lever 14 is urged to rotate clockwise (CW) by card presser spring 15 to card holding members 17 against card holding members 16 for holding card 100.

As slider 8 is lifted up by card transport drive pin 13, slant section 14*c* of card holder lever 14 abuts lever drive projection 5*f*. Slant section 14*c* then starts slipping and riding over lever drive projection 5*f*, thus rotating card holder lever 14 in the counterclockwise (CCW) direction. As a result of this operation the card holding members 16 and 17 are gradually separated, thus, releasing card 100. As shown in FIG. 14, the card holder mechanism completely opens when slider 8 reaches the upper most position of guide frame 5, thus enabling card 100 to be insert or removed.

Referring again to FIG. 14, card holder lever 14 does not receive any force to move up or down along guide frame 5 because slant section 14*c* no longer abuts on lever drive projection 5*f* and card holder lever 14 completely rides over plane section of projection 5*f*. As a result, motor 6 does not have to be energized the holding current applied while the card holding members 16 and 17 are in the open position. This reduces the power consumption of and heat generated by the printer.

THE SECOND EMBODIMENT

The second embodiment of a printer according to the present invention is described below with reference to FIGS.

15 to 29 and FIG. 1. FIG. 1 is a perspective view of the printer to which the card transport mechanism according to the second embodiment is installed as described above in the first embodiment.

Figure 15:
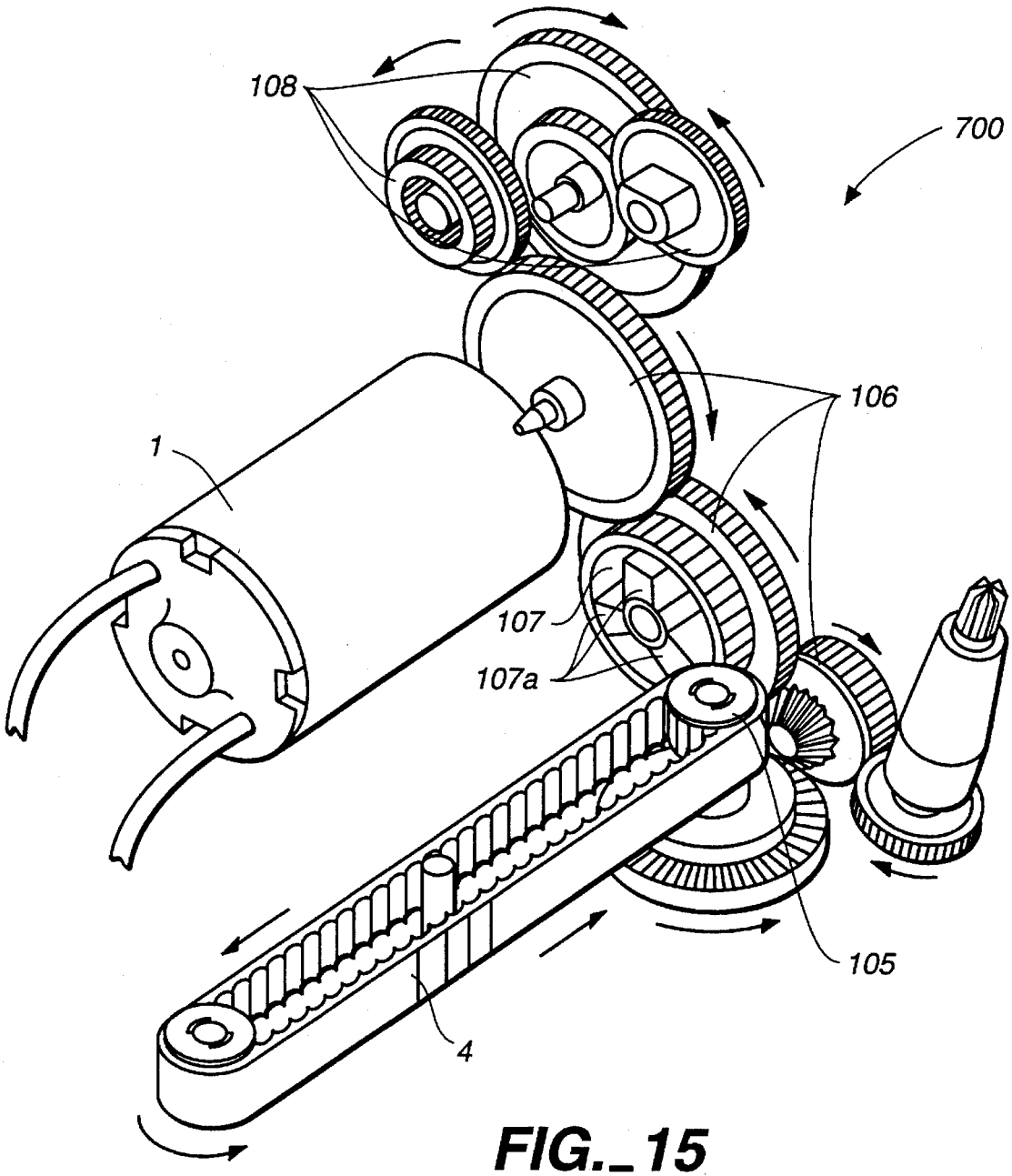
FIG. 15 is a perspective view of a motor and transmission means of the card transport mechanism of FIG. 16.

FIG. 15 is a perspective drawing of a transmission means 700 for transferring the drive power of motor 1 in the second embodiment to carriage drive belt set 4. Transmission means 700 comprises drive pulley 105, paper transport gear train 108 and head transport gear train 106 including head transport gear 107.

Motor 1 rotates carriage drive pulley 105 via transmission means 700 in a known manner. As such a detailed discussion will be omitted. Motor I also drives paper transport gear train 108, which selectively transfers the motor torque to the roll paper transport mechanism (not shown in the figures) used to feed a roll paper for printing. Head transport transfer gear 107 is one of the gears constituting head transport gear train 106 and comprises three tabs 107*a* projecting in three directions. Head transport transfer gear 107 functions as to transfer drive power to the card transport mechanism 150.

Figure 16:
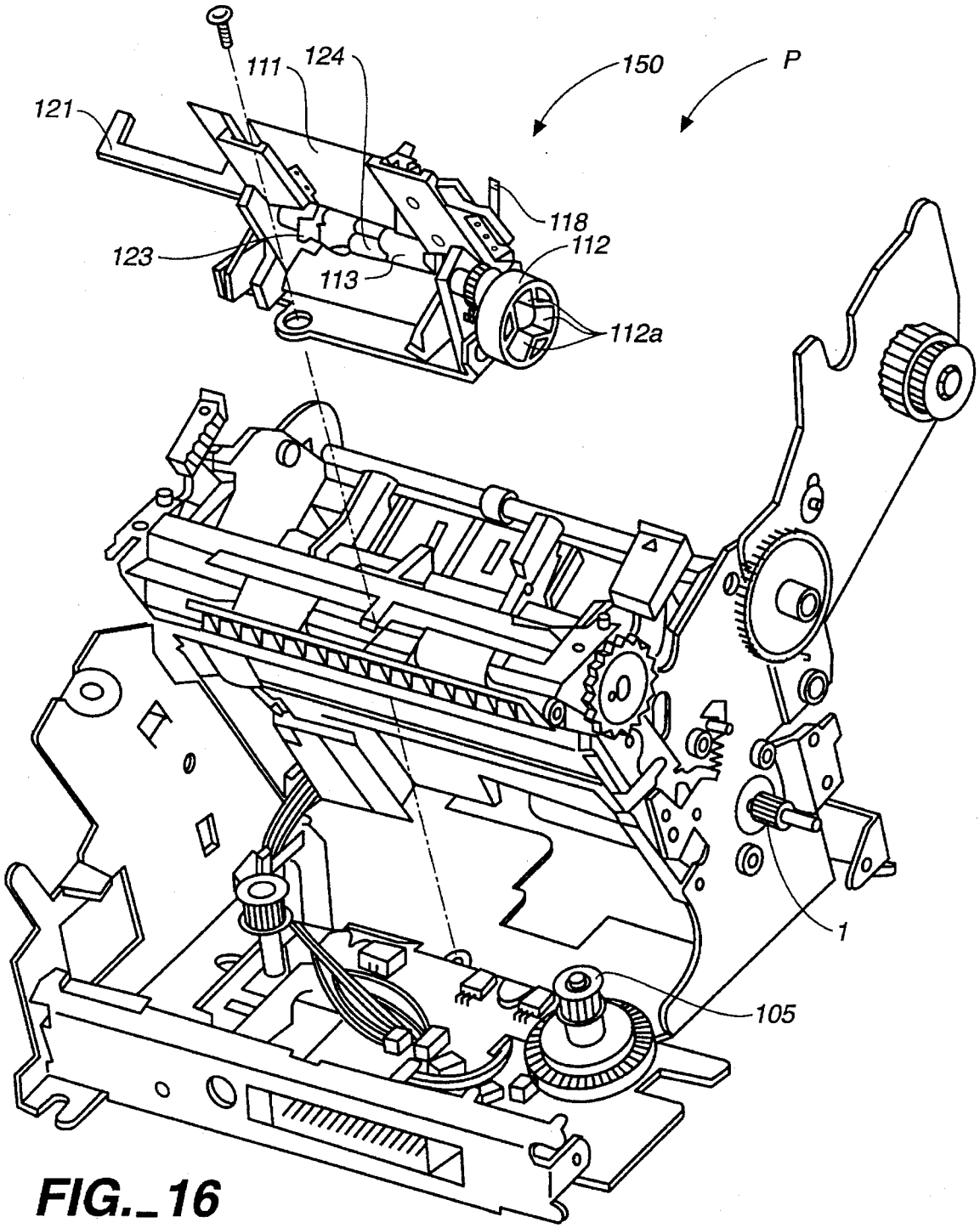
FIG. 16 is a perspective view of a printer having a card transport mechanism according to a second embodiment of the present invention.

FIG. 16 is a front perspective view of the card transport mechanism according to the second embodiment of the invention illustrating its arrangement in the printer.

Figure 28:
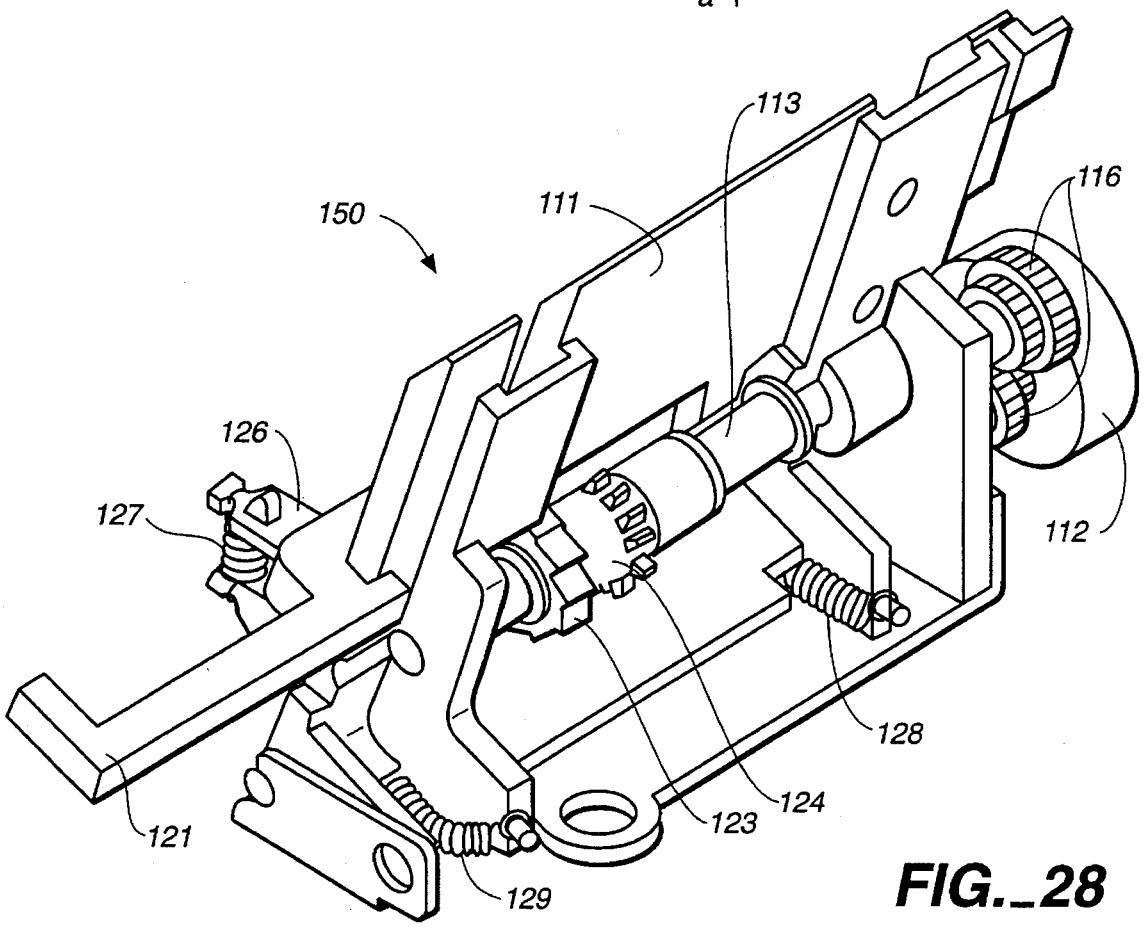
FIG. 28 is a front perspective view of the card transport mechanism in accordance with the second embodiment.
Figure 29:
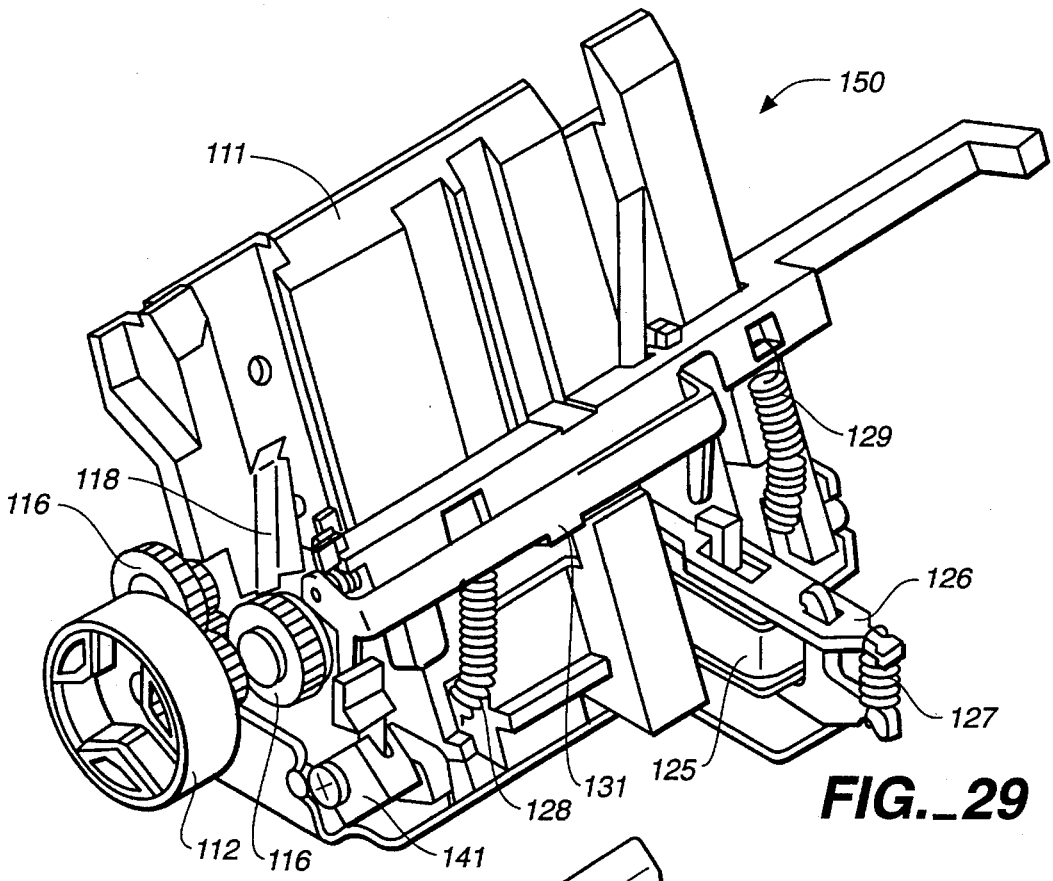
FIG. 29 is a rear perspective view of the card transport mechanism of the second embodiment.

FIG. 28 is a front perspective view of card transport mechanism 150, and FIG. 29 is a rear perspective view thereof.

Figure 17:
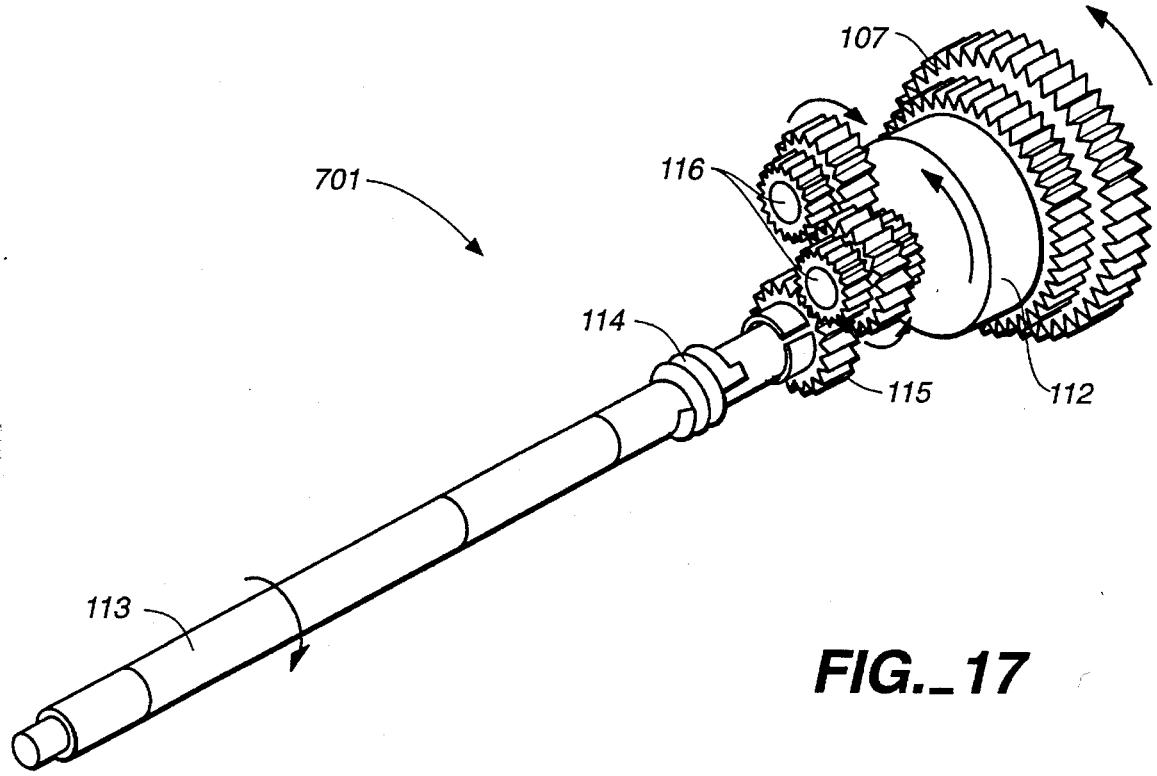
FIG. 17 is a perspective view of the power transmission mechanism of the card transport mechanism in accordance with the second embodiment of the present invention.
Figure 18:
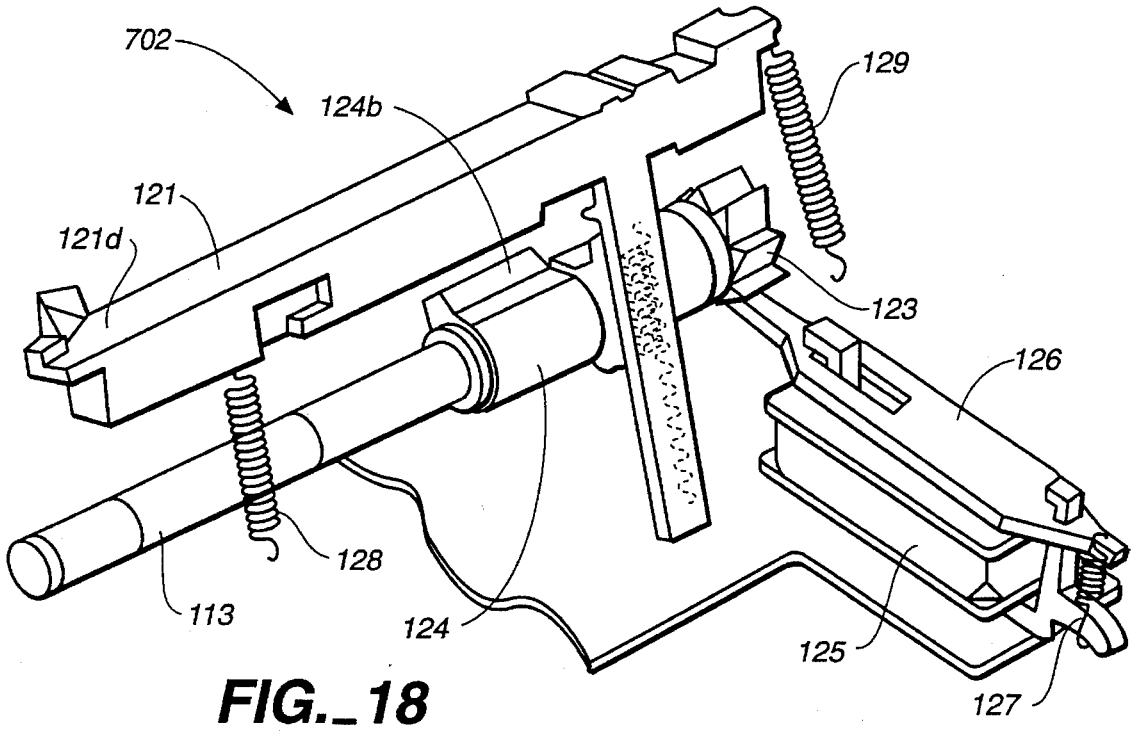
FIG. 18 is a partial perspective rear view of the card transport mechanism having a slider drive mechanism in accordance with the second embodiment of the present invention.
Figure 22:
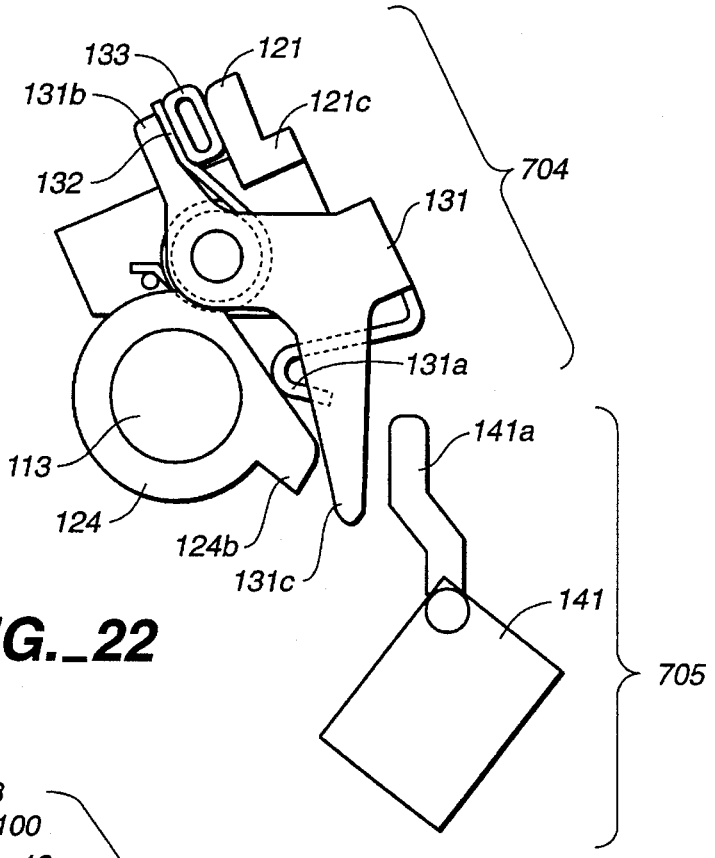
FIG. 22 is a side view of a card presser assembly of the card transport mechanism of FIG. 16 in the closed position for holding a card.

In accordance with the second embodiment the card transport mechanism 150 comprises a card transport power transmission assembly 701, as best seen from FIG. 17, a card transport assembly 702, as best seen from FIG. 18, a card presser or holder assembly 704, as best seen from FIG. 22, and a card holder lever position detector assembly 705, also as best seen from FIG. 22.

Referring to FIGS. 16 and 17, the card transport mechanism 150 comprises a guide frame 111 for supporting card transport power transmission assembly 701, card transport assembly 702, card presser assembly 704, and card holder lever position detector assembly 705. In the preferred embodiment, card transport power transmission 701 assembly comprises a card transport power transmission gear 112 having three holes 112*a* on one side for engaging with three tabs 107*a* of head transport transfer gear 107, and a gear assembly 116 arranged on the opposite side. Gear assembly 116 is operatively engaged to slider drive gear shaft 113 through shaft gear 115. Shaft gear 115 is disposed at a proximal end of slider drive gear shaft 113.

Slider drive gear shaft 113 transfers power to the card transport mechanism 150 and includes a power transmission spring 114 such as a spring clutch wound around slider drive gear shaft 113. One end of power transmission spring 114 is bent up to a raised position and adjusted to slip when a torque greater than a predetermined amount is applied to the drive system downstream from slider drive gear shaft 113. Card transport transfer gear 115 is slipped over and turns on slider drive gear shaft 113 and comprises a hole for engaging the raised part of power transmission spring 114. Card transport power transmission gear train 116 reduces the rotational speed of card transport power transmission gear 112 and transfers the drive power to card transport transfer gear 115.

Figure 19:
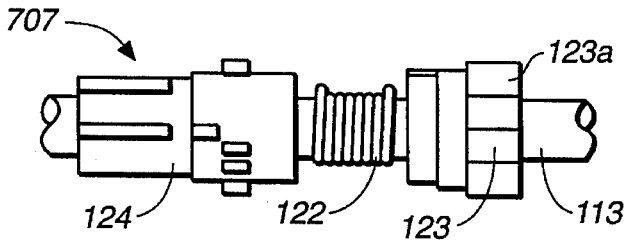
FIG. 19 is a perspective exploded view of a clutch mechanism of a slider drive gear shaft in accordance with the second embodiment of the present invention.
Figure 20:
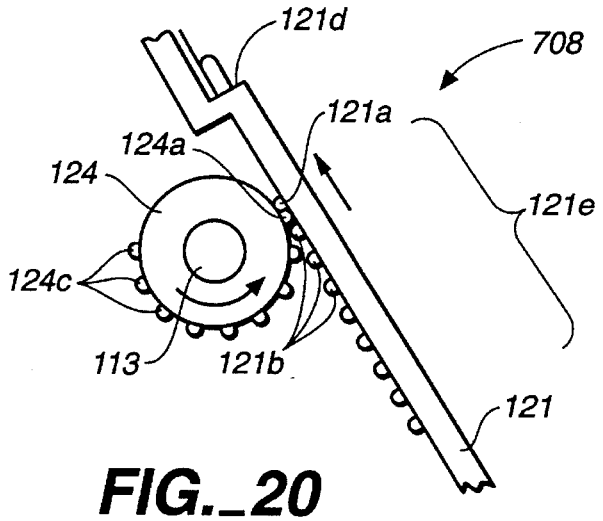
FIG. 20 is a side view of a rack and pinion mechanism of the second embodiment of the present invention.
Figure 21:
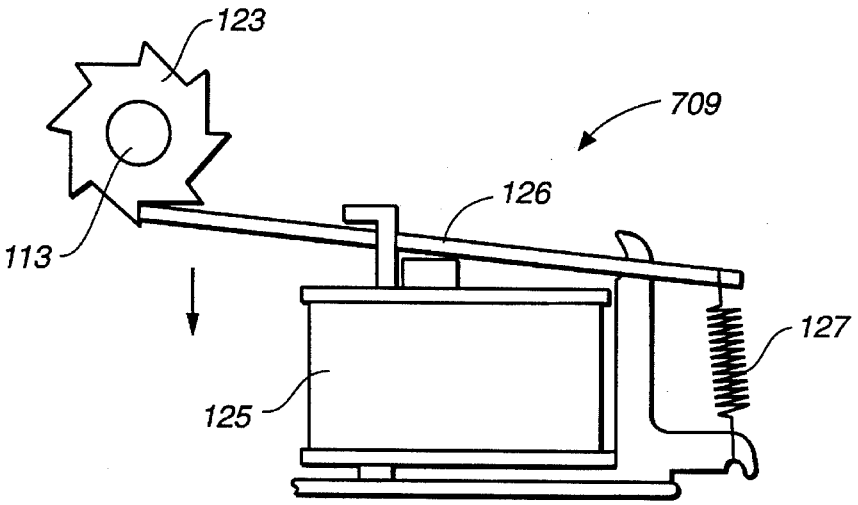
FIG. 21 is a side view of a trigger mechanism for the card transport mechanism of FIG. 16.

FIG. 18 is a rear view of the card transport mechanism 150 and depicts the driving operation of slider 121. FIG. 19 is a front exploded view of the clutch mechanism 707 of the slider drive gear shaft 113. FIG. 20 illustrates the a rack mechanism 708 provided on slider 121 and the pinion gear 124 disposed on slider drive gear shaft 113. FIG. 21 shows a trigger mechanism for card transport selection.

As shown in FIG. 29, slider 121 is mounted on and moves parallel to frame 111. Frame 111 is preferably fabricated from molded plastic. However as will be appreciated by one of ordinary skill in the art, other suitable materials may be employed. Slider 121 comprises card stop 121*d* against which the bottom edge of card 100 stops and a rack 121*e* wherein the top gear 121*a* that meshes first is offset in width from the other gears 121*b*. Slider 121 functions both as a card stop and for card transport.

As shown in FIG. 19, slider drive spring 122 is a spring clutch pressure fit to slider drive gear shaft 113. Both ends of slider drive spring 122 are bent out to a raised position from slider drive gear shaft 113. Additionally, slider drive ratchet 123 fits over and is rotatably arranged on slider drive gear shaft 113. The ratchet teeth 123*a* of slider driver ratchet 123 are uniformly distributed around the outside circumference of the ratchet wheel. Slider driver ratchet 123 engages one of the raised ends of slider drive spring 122, and slider drive gear 124 fits over and rotates on slider drive gear shaft 113. Slider drive gear 124 engages with the other raised end of slider drive spring 122 and comprises on the outside circumference thereof gear 124*a* for meshing with the top gear 121*a* on rack 121*e* of slider 121, gears 124*c* for meshing with the other gears 121*b*, and trapezoidal-shaped cam 124*b* shown in FIGS. 22 and 23.

Referring now to FIG. 21 card transport mechanism 150 comprises a card transport solenoid or electromagnet 125 for generating an attractive magnetic force in its core (not shown in the figures) when energized. One end of slider drive trigger plate 126 engages slider drive ratchet 123, and is positioned so that the engagement can be released by energizing card transport electromagnet 125. Attraction leaf spring 127 is connected at the other end of slider drive trigger plate 126, causing the first end of slider drive trigger plate 126 to engage the claws 123*a* of slider drive ratchet 123 when card transport electromagnet 125 is deenergized.

As shown in FIGS. 18 and 28 slider return spring 128 is connected to guide frame 111 on one end and to slider 121 on the other end in order to bias slider 121 in the return direction and to hold slider 121 in the down or standby position. As best seen in FIG. 28, slider return spring 129 performs the same function as slider return spring 128. Slider 121 can thus move smoothly on guide frame 111 because slider return spring 128 and slider return spring 129 are positioned to be balanced on both the right and left sides of slider 121.

Figure 23:
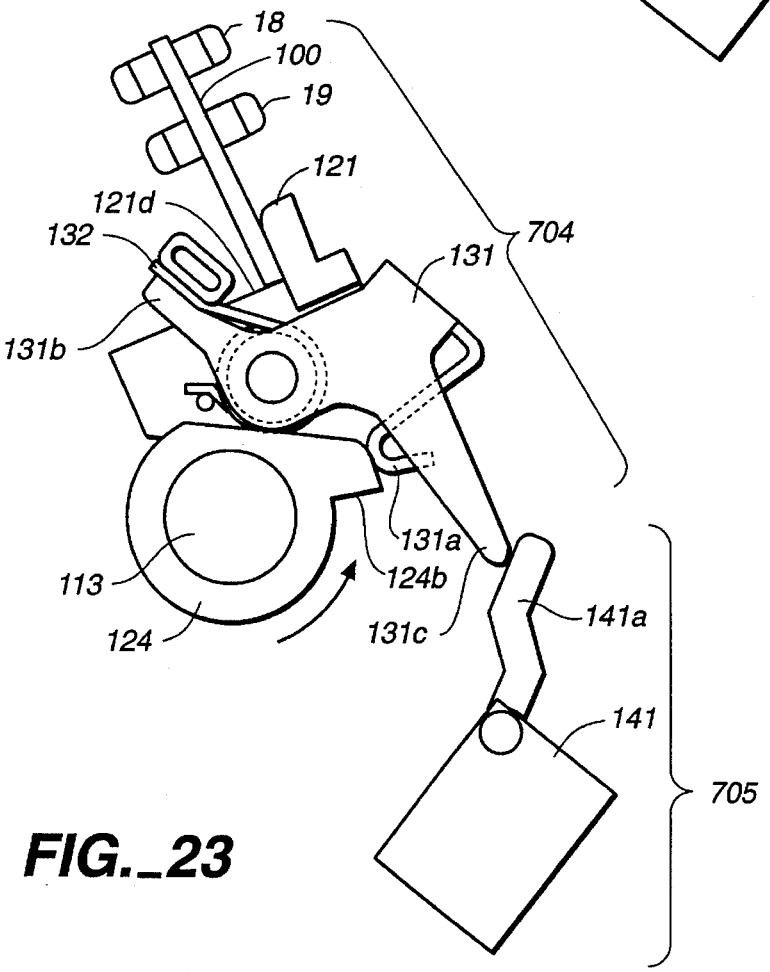
FIG. 23 is a side view of a card presser assembly of the card transport mechanism of FIG. 16 in the open position for accepting or for releasing the insertion of a card.

FIGS. 22 and 23 depict card holder assembly 704 and card holder lever position detector assembly 705. FIG. 22 is a side view of the card holder assembly 704 according to the second embodiment illustrating a card being held therein and the card holder lever detector assembly 705 in the undetected position. Alternatively, FIG. 23 shows the card holder assembly 705 in the open position for card insertion or release and card holder lever detector assembly is in the detected position.

Referring again to FIGS. 22 and 23 card holder lever 131 is mounted on and rotates on slider 121. Card holder assembly 704 comprises holding members 133 on card holder lever 131 for frictionally holding card 100 in combination with fixed holding members 121*c* formed on the end portions of slider 121. Card holding members 121*c* are arranged opposite to and facing holding members 133. Holding members 133 are preferably fabricated from rubber or any suitable material to frictionally hold card 100. Card holder lever 131 further comprises arm 131*a*, which is positioned to contact with trapezoidal cam 124*b* disposed on slider drive gear 124, and detection lever 131*c* which operates card holder lever position detector 141.

Card presser spring 132 is provided and comprises a torsion coil spring for applying sufficient force to holding members 133 to hold card 100. Card holder lever position detector 141 is implemented as a mechanical switch fixedly secured to guide frame 111 and comprises lever 141*a* for engaging with detection lever 131*c* of card holder lever 131. Card holder lever position detector 141 outputs a HIGH level signal when lever 141*a* rotates in the clockwise direction as seen in FIG. 22. In other words when lever 141*a* is not driven to the right detector 141 outputs a HIGH signal. On the other hand when detection lever 131*c* rotates counterclockwise and the lever 141*a* is forced to move toward the right, the card holder lever position detector 141 outputs a HIGHlevel signal. As will be appreciated, card holder lever position detector 141 may be implemented as a photodetector positioned such that the light beam thereof is interrupted by card holder lever 131 to enable position detection.

As best seen in FIG. 23, card detector 18 is preferably a light-transmitting photo detector provided at the card 100 insertion opening for outputting a signal when a card is inserted. Card detector 19 is provided near the card stop of slider 121, and outputs a signal when the card is positioned towards the lower portion of frame 111.

Figure 24:
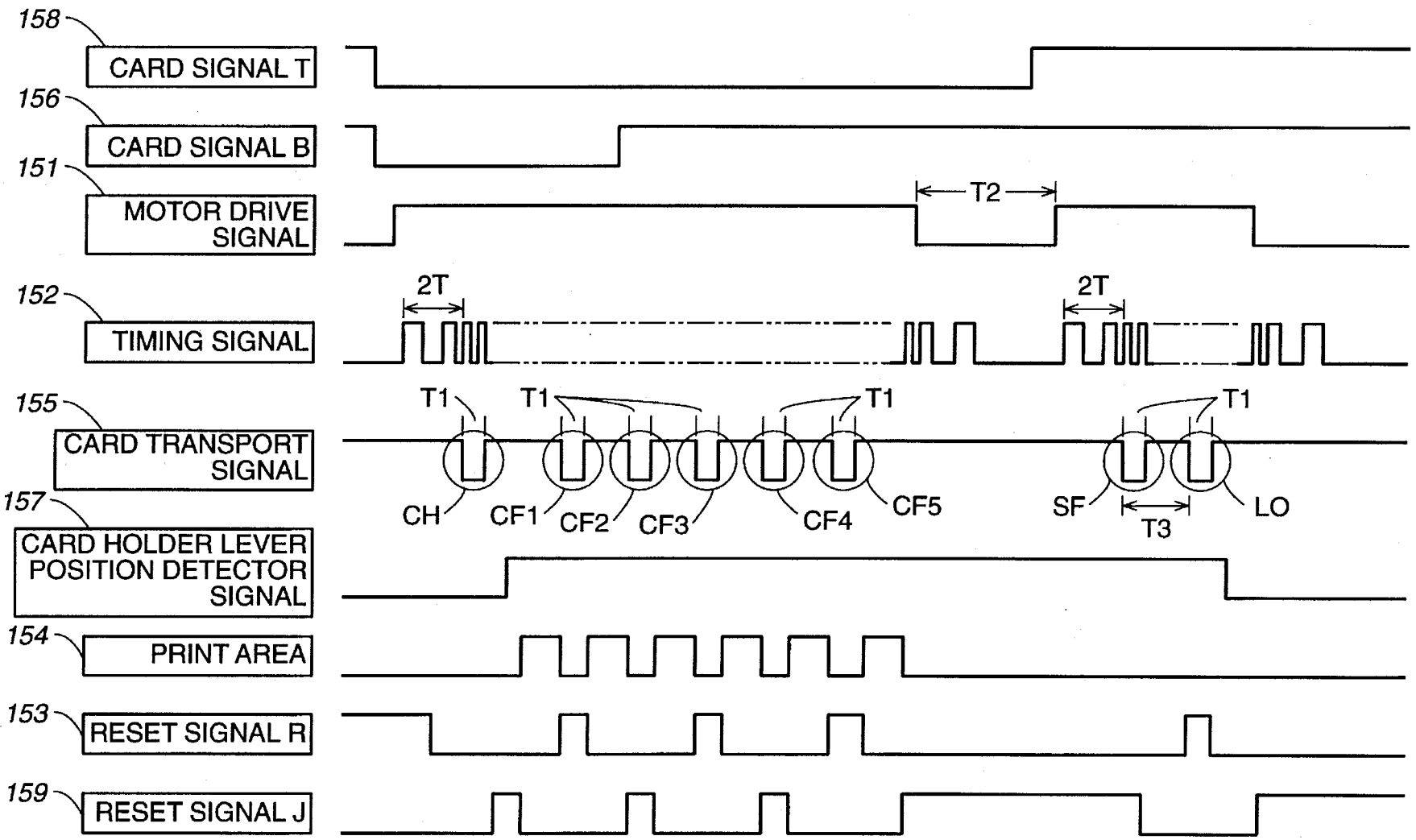
FIG. 24 is a timing chart of the card printing and card transport timing in accordance with the second embodiment of the present invention.

FIG. 24 is a timing chart of the card printing timing and card transport timing in accordance with the second embodiment of the present invention. The various timing signals shown therein are as follows. Motor drive signal 151 is a control signal for driving motor 1. Timing signal 152 is the shaped output signal generated by timing pulse generator 51 (not shown in the figures) in synchronism with motor 1 rotation used to determine the drive timing of print head 2. Reset signal 153 is the shaped output signal generated by reset pulse generator 52 (not shown in the figures) in response to a detector, such as, a photo-detector provided at the receipt paper side of the main frame for outputting a signal when carriage 3 reaches the home position on the receipt side. Reset signal 159 is the shaped output signal generated by reset pulse generator 53 (not shown in the figures) in response to a detector, such as, a photo-detector provided at the journal paper side of the main frame for outputting a signal when carriage 3 reaches the home position on the journal side. Print area signal 154 indicates the timing during which printing is possible.

Card feed signal 155 is used to energize card transport electromagnet 125 (FIG. 21) in trigger assembly 709 for selectively performing the card transport. Card holder lever position detector signal 157 is output by card holder lever position detector 141 as a LOW level signal in the state where the card holder lever position is detected (card insertion enabled state).

Card detection signal 156 is the output signal generated by card detector 19 (FIG. 23), which outputs card signal 156 with a HIGH level when no card is loaded in the printer and outputs a LOW level signal when a card is loaded in the printer. Card detection signal 158 is the output signal of card detector 18 (FIG. 23), which outputs a HIGH level signal when no card is loaded and outputs a LOW level signal when a card is loaded in the printer; this operation is similar to that of card detector 19.

Figure 25:
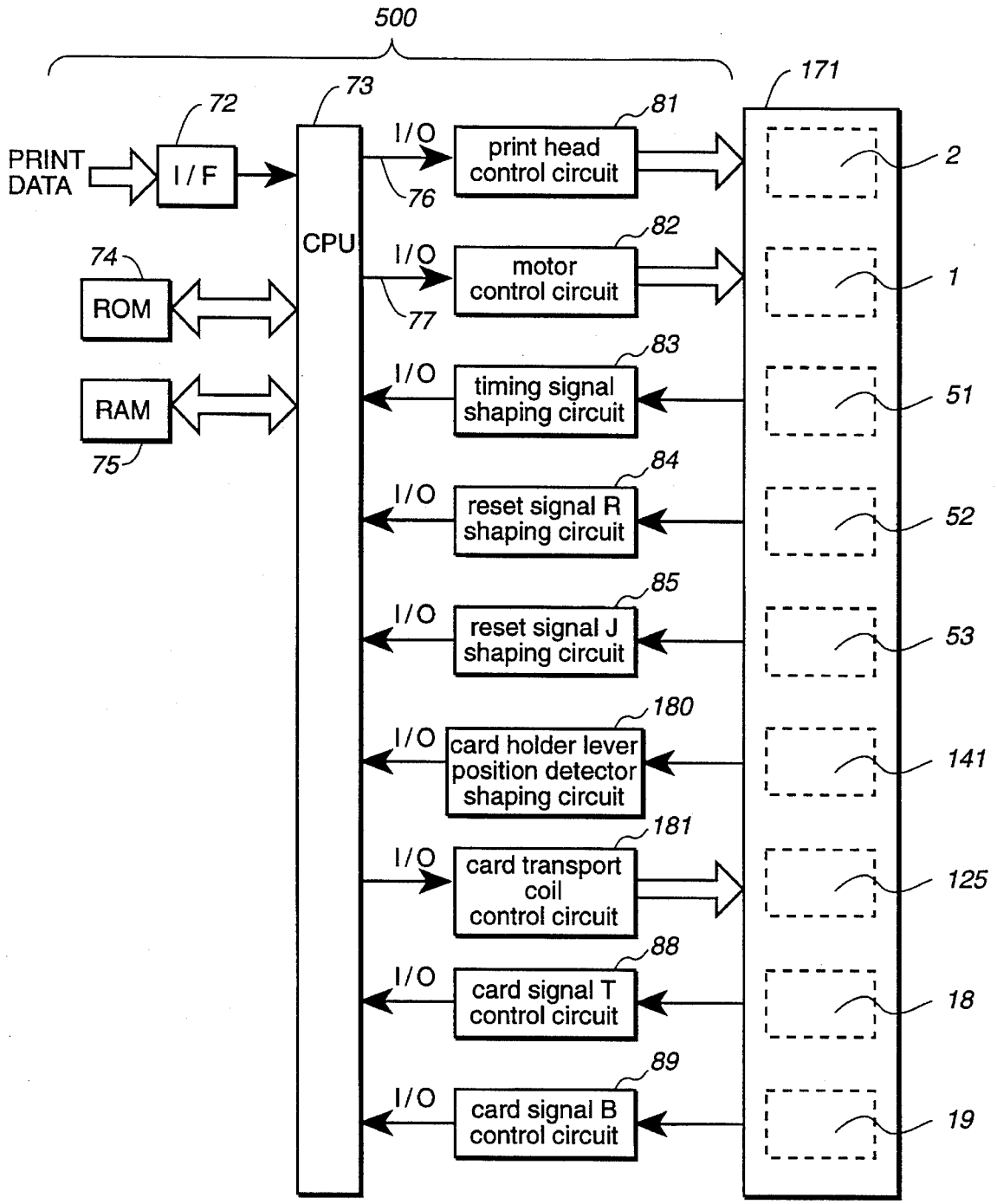
FIG. 25 is a block diagram of the overall configuration of a printer in accordance with the second embodiment of the present invention.

FIG. 25 is a block diagram of the overall configuration of a printer using the card transport mechanism according to the second embodiment of the present invention. In FIG. 25, outline 171 represents the printer mechanism according to the second embodiment as described above. As noted above the printer mechanism in accordance with the second embodiment comprises print head 2, motor 1, card transport electromagnet 125, timing pulse generator 51, card holder lever position detector 141, reset pulse generator 52, reset pulse generator 53, card detector 18, and card detector 19, each represented by an outline of the same number.

As in the first embodiment, the printer comprises CPU 73 connected to print head control circuit 81, motor control circuit 82, and card transport electromagnet control circuit 181, as well as interface 72, ROM 74, and RAM 75. CPU 73, interface 72 print head control circuit 81, ROM 74 and RAM 75 operate substantially similar to the first embodiment. Therefore a detailed explanation will be omitted. Print head control signal 76, motor control signal 77, and card transport electromagnet control signal 186 are output from CPU 73 to print head control circuit 81, motor control circuit 82, and card transport electromagnet control circuit 181, respectively.

Timing signal shaping circuit 83 shapes the signal generated by timing pulse generator 51, and outputs timing signal 152, which is used as the reference signal for controlling the power supply to print head 2, to CPU 73. Reset signal R shaping circuit 84 supplies CPU 73 with reset signal R 153, which is generated by reset pulse generator 52 indicating the printing enabled status when carriage 3 moves to the printer standby position. Reset signal J shaping circuit 85 supplies CPU 73 with reset signal 159, which is generated by reset pulse generator 53 indicating the printing enabled status when carriage 3 moves to the printer standby position.

Card holder lever position detector signal shaping circuit 180 supplies CPU 73 with card holder lever position detector signal 157, which is required to evaluate whether or not card holder lever 131 is in the standby position (i.e., whether card insertion is possible or not). Card signal T shaping circuit 88 outputs card signal 158 generated by card detector 18 to CPU 73, enabling CPU 73 to evaluate whether or not a card is inserted and whether or not the card has been removed. Card detection signal B shaping circuit 89 shapes and outputs card detection signal 156 sent by card detector 19 to CPU 73, enabling CPU 73 to evaluate whether or not a card is inserted.

Figure 26:
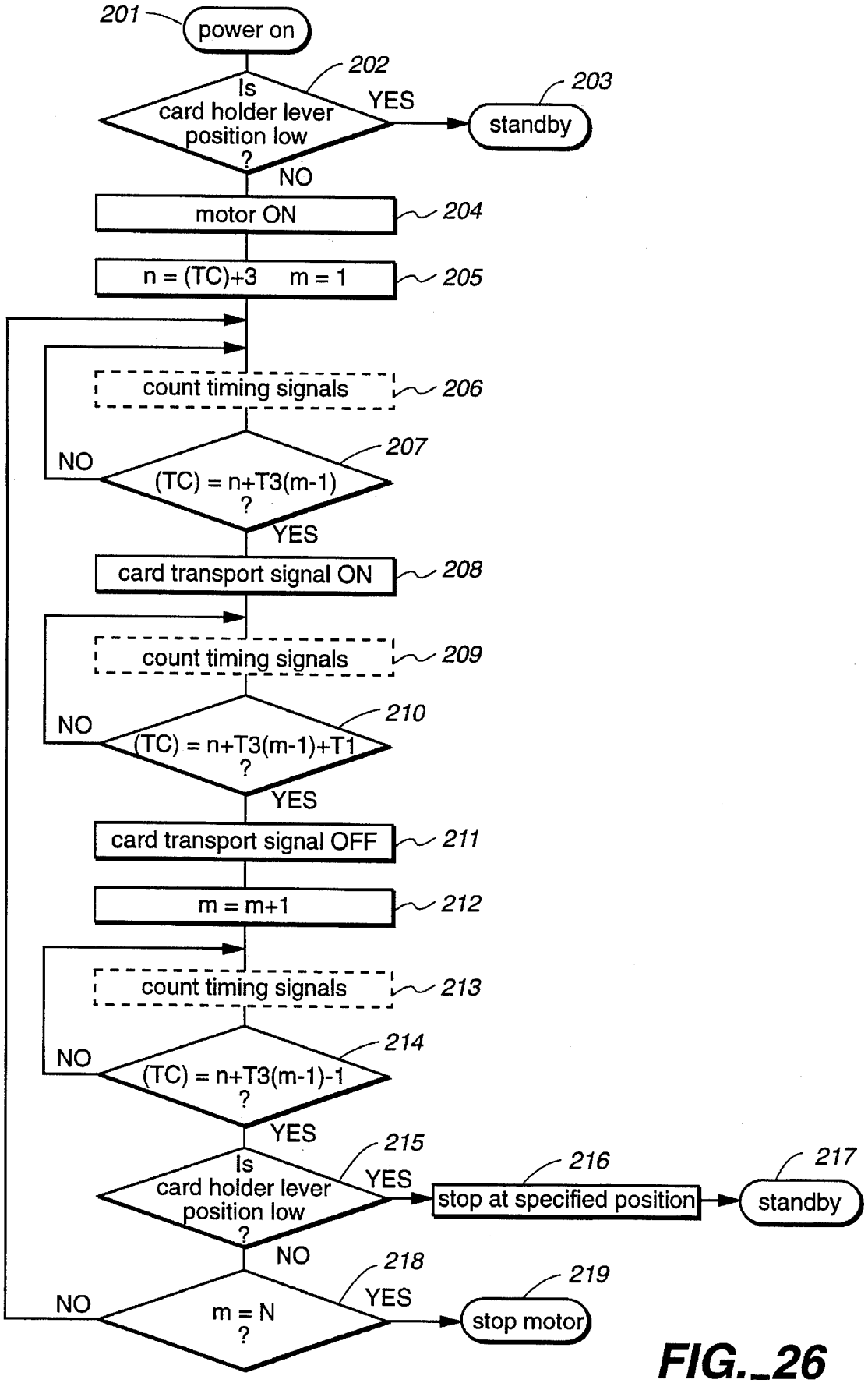
FIG. 26 is a flow chart of the initializing operation of the card transport mechanism of the FIG. 16.

FIG. 26 is a flow chart of the operation initializing the card transport mechanism of the embodiment to enable card insertion. The initializing sequence is described later in detail hereinbelow.

Operation of the card transport mechanism according to the second embodiment of the present invention is described below. The standby state is described first.

As shown in FIG. 23, trapezoidal cam 124*b* of slider drive gear 124 lifts arm 131*a* of card holder lever 131 causing it to turn counterclockwise, thus opening a space between fixed holding members 121*c* on the both right and left sides of slider 121 and card holding members 133 of card holder lever 131. This is the card insertion enabled state. Because detection lever 131*c*, which indicates the rotational position of card holder lever 131, rotates and holds lever 141*a* of card holder lever position detector 141, card holder lever position detector signal 157 output from card holder lever position detector 141 becomes and maintains a LOW level indicating that card insertion is possible.

When card 100 is then inserted along guide frame 111 and card guide 118, card 100 is led between slider 121 and arm 131*b* of card holder lever 131. The side edge of card 100 thus blocks the light beam of card detector 19, which is located near the lower standby position of slider A 121 in the card 100 insertion path. This causes card detection signal 156 (FIG. 24) output from card detector B 19 to change to a LOW level signal. Card detection signal 158 changes similarly.

Card detection signal 156 is therefore input through card detection signal B shaping circuit 89 (FIG. 25) to CPU 73, causing CPU 73 to output motor drive signal 151 (FIG. 24) with a HIGH level through motor control circuit 82 to drive motor 1. As a result, motor 1 begins to turn, driving head transport gear train 106 and paper transport gear train 108 (FIG. 15), and head transport transfer gear 107, card transport power transmission gear 112, card transport power transmission gear train 116, card transport transfer gear 115, and slider drive gear shaft 113 (FIG. 17) in the directions of the respective arrows.

As shown in FIG. 21, rotation of slider drive ratchet 123 is inhibited by slider drive trigger plate 126. As a result, rotation of slider drive gear shaft 113 is not transferred to slider drive gear 124, and slider drive gear 124 does not turn, because slider drive spring 122 in the clutch assembly loosens.

Next, timing signal 152 is applied from CPU 73 (FIG. 25) through card transport electromagnet control circuit 181 to card transport electromagnet 125 for only period T1 (LOW level period (indicated as CH) of card feed signal 155 (FIG. 25). Slider drive trigger plate 126 is therefore pulled in the direction of the arrow, overcoming the tension of attraction coil spring 127 by card transport electromagnet 125 (FIG. 21), releasing engagement with slider drive ratchet 123, and enabling slider drive ratchet 123 to turn with slider drive gear shaft 113.

Slider drive spring 122 therefore tightens against slider drive gear shaft 113, and slider drive gear 124 turns together with slider drive gear shaft 113. Because current is applied to card transport electromagnet 125 only during period T1, slider drive trigger plate 126 is activated and returned by attraction coil spring 127 when the current supply to card transport electromagnet 125 is stopped, thus causing slider drive trigger plate 126 to engage the next claw of slider drive ratchet 123 and prohibiting slider drive ratchet 123 to rotate beyond the next claw. Trapezoidal cam **124*b* of slider drive gear 124 (FIG. 23) turns in the direction of the arrow. When trapezoidal cam 124*b* has passed by ann 131*a* of card holder lever 131, card holder lever 131 rotates clockwise, and the card is held by card holding members 133 under the urging of card presser spring 132. At the same time, lever 141*a* of card holder lever position detector 141 and detection lever 131*c* of card holder lever 131 separate, card holder lever position detector signal 157 (FIG. 24**) becomes HIGH, and the card is held firmly to enable printing.

The printing and card transport operation is described next.

As motor 1 is driven further, reset signal 153 or reset signal 159 (FIG. 24) output from reset pulse generator 52 or reset pulse generator 53 (not shown), respectively, are obtained for confirmation of the carriage 3 home position. CPU 73 outputs the print command to print head control circuit 81 while print area signal 154, which indicates printing to the present print line is possible, is active to execute printing. Note that print area signal 154 is provided by a logic circuit in synchronism with the reset signals.

After printing one line, when card feed signal 155 (FIG. 24) is similarly set LOW as indicated by CF1 and current is applied to card transport electromagnet 125, slider drive ratchet 123 advances one claw, and slider drive gear 124 is advanced to feed the card to the next print line. Slider 121 is thus advanced one print line by the action of the rack of slider 121 engaged with the gear member of slider drive gear 124, and the card is thus advanced one print line.

The present embodiment is shown in a six line printer configuration. The number of printable lines is determined by amount of the printer spacing. The print/card transport operation described above is repeated five times for periods CF1 to CF5 to print six lines.

When the last line has been printed, card 100 has been advanced to the top position. Therefore, stop period T2 of motor drive signal 151 should be set long enough to remove the card. If card detector T 18, which is an optional detector, is provided, removal of the card can be detected by a HIGH level of card signal T 158, thus omitting to set stop period T2.

Note that because there is a gap between slider 121 and guide frame 111, which guides slider 121, slider 121 can potentially rock by an amount equal to this gap during card printing, causing the print position to be unstable and print quality to deteriorate. The means illustrated in FIG. 27 prevents this.

Figure 27:
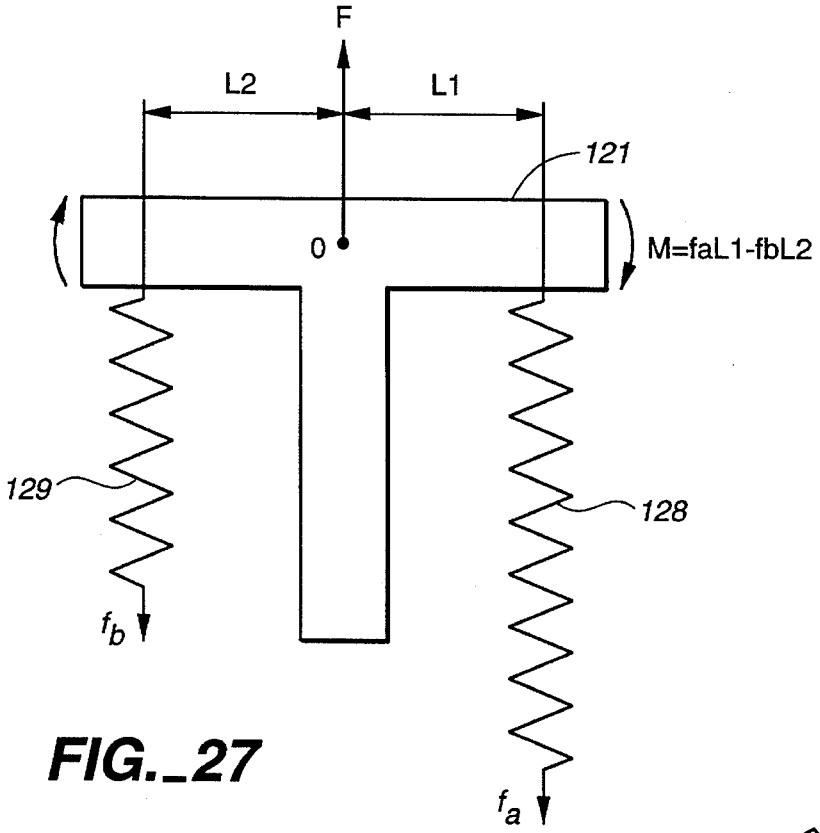
FIG. 27 is a schematic diagram illustrating the relationship between the forces acting on the slider in accordance with the second embodiment of the present invention.

Referring to FIG. 27, slider return spring 128 is tensioned to load $f_a$ at distance L1 and slider return spring 129 is tensioned to load $f_b$ at distance L2 against the force F acting on slider 121 when slider drive gear 124 works to move slider 121 up. Note that the moment $M(=f_aL1-f_bL2)$ applied at point O is increased so that slider 121 always tilts to one side, thus preventing slider 121 from rocking while printing. In this embodiment, $f_a>f_b$ and L1>L2.

The slider 121 resetting and card holder lever 131 opening operations are described next. After the card is removed, motor drive signal 151 (FIG. 24) is then set HIGH level and motor 1 is driven. When slider drive gear 124 is driven by the LOW level signal of card feed signal 155 indicated by SF in FIG. 24, the last tooth of slider drive gear 124 (FIG. 20) disengages from the rack **121*e* of slider 121, and slider 121 is moved down to the home position by the action of slider return spring 128 and slider return spring 129. The wait period T3 (more precisely T3 minus T1, see FIG. 24) of card feed signal 155 is set longer than the time required for slider 121** to settle at the home position.

When slider drive gear 124 is then driven by inputting a LOW level of card feed signal 155 (FIG. 24), trapezoidal cam **124*b* of slider drive gear 124 pushes to open card holder lever 131. Detection lever 131*c* of card holder lever 131 simultaneously activates lever 141*a* of card holder lever position detector 141 to output card holder lever position detector signal 157 (FIG. 24**) with a LOW level, and card insertion is enabled. The above three steps, namely card holding step, card printing transferring step and returning step, complete one cycle.

The initialization operation of card holder lever 131 in the card transport mechanism when the printer power is turned on is described next in detail along the flow chart in FIG. 26.

Note that in the flow chart of FIG. 26, (TC) in steps 205, 207, 210, and 214 indicates the count value of the timing signal counter which is a type of free running counter in the present embodiment; T3 and T1 are numbers of timing signal 152 to be counted during a respective period when waiting for slider 121 to return and settle at the bottom standby position and when card feed signal 155 is LOW level enabling slider drive gear 124 to rotate; and N in step 218 is the number of card transport signal operation of one cycle minus 1 because the card transport mechanism is a cycle machine and all of the states appear by changing its state as many as the number of state minus 1.

After the power is turned on (step 201 ), a LOW card holder lever position detector signal state is checked (step 202). If the card holder lever position detector signal is LOW, card setting is enabled, and the printer enters the standby state (step 203) until a card is inserted.

If the card holder lever position detector signal is not LOW, slider 121 and arm 131*b* of card holder lever 131 are closed (FIG. 22), and card insertion is not possible. The following steps are therefore executed to initialize the printer for card insertion.

Specifically, motor 1 is driven (step 204) and the values n=(TC)+3 and m=1 are set (step 205). Note that motor 1 can rotate at a stable speed within 3 counts of timing signals from starting to rotation. The timing signals are then counted (step 206) until (TC)=n+T3(m−1) (step 207).

When step 207 returns YES, the card transport signal is set ON (step 208), and current is supplied for period T1 only (steps 209, 210, 211). When m=m+1 (step 212), the timing signal is counted until (TC)=n+T3(m−1)-1 (steps 213, 214). In these steps, it takes a period of T3−T1−1 which is enough time for slider 121 to settle after returning. Card holder lever position detector signal state is again checked (step 215) whether it is LOW. If step 215 returns YES, card setting is possible. Since the standby state is detected at this time, the motor is therefore stopped (step 16), and the printer stands by until a card is inserted (step 217). If step 215 returns NO and m≠N, the procedure loops back to step 206. If step 215 returns NO and m=N (step 218), however, there must be some problems in the printer assembly and the motor is stopped (step 219).

In the above embodiment, card holding and transport and printer standby states can be easily achieved with a single low-cost trigger assembly using the power of a motor driving both the paper transport and carriage drive assemblies. A unitized card transport mechanism enabling simple installation and removal from the printer assembly can thus be achieved.

The following advantages are obtained by means of the invention described above.

By providing a slider comprising a card stop against which the bottom edge of the printer card rests and a holding means for holding the card, a guide frame comprising at least one guide member engaging and moving the slider parallel to the guide frame, and a movement drive means for moving the slider holding the card along the guide member relative to the printing means, the card is simply held between clamping members and advanced by moving the slider on which it is held. It is therefore possible to reliably advance multiple part card forms.

In addition, because the card is advanced by simply moving the slider and card transport does not rely upon friction, which is used by the prior art and varies easily, it is possible to provide a high reliability printer with high precision paper feed control. The practical benefit of this high precision is particularly noticeable with pre-printed card forms.

Because the cards are held by mechanical force, the heat resulting from extended operation of electromagnets and plungers used to hold the cards in the prior art is eliminated, and multiple line printing taking an extended period of time is possible.

Power consumption is also reduced, making it possible to use a smaller power supply and improving the energy efficiency of the printer.

By providing a stop limiting the range of slider movement on the guide frame and operating a card holder lever by means of a card transport drive pin after slider movement is stopped by the stop to release the moving holding member clamping the card in place, it is possible to clamp the card with the slider near the card insertion opening. It is therefore easier to set a card in the printer, short printing forms can be easily loaded into the printer, and the printer is easier to use.

Because the card transport mechanism comprises a slider on a guide frame and a means for driving the slider, the card transport mechanism can be manufactured as a single unit that can be used to help greatly reduce printer assembly costs. Because this unit can also be assembled into the printer as an option during final printer assembly, printer design specifications can be easily changed. Control is also extremely simple because the card can be driven alone by applying a signal to a single means as when controlling a stepping motor or trigger magnet to move the slider.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

| Reference Numerals | |
|---|---|
| 1 | motor |
| 2 | print head |
| 3 | carriage |
| 4 | carriage drive belt set |
| 5 | guide frame |
| 5c | guide position |
| 5f | projection |
| 6 | card transport motor |
| 7 | card transport belt |
| 8 | slider |
| 8a | tab |
| 8b | abutting section |
| 8c | channel |
| 9 | slider position detector |
| 10 | card transport power transmission gear train |
| 11 | belt drive pulley |
| 12 | belt idler pulley |
| 13 | card transport drive pin |
| 14 | card holder lever |
| 14a | engaging member |
| 14b | pivot section |
| 14c | slant section |
| 15 | card presser spring |
| 16 | holding member |
| 17 | holding member |
| 18 | card detector |
| 19 | card detector |
| 20 | slider presser lever |
| 21 | slider presser spring |
| 22 | belt tension lever |
| 22a | screw |
| 25 | platen |
| 51 | timing pulse generator |
| 52 | reset pulse generator R |
| 53 | reset pulse generator J |
| 71 | printer assembly |
| 72 | interface |
| 73 | CPU |
| 74 | ROM |
| 75 | RAM |
| 81 | print head control circuit |
| 82 | motor control circuit |
| 83 | timing signal shaping circuit |

-continued

| Reference Numerals | |
|---|---|
| 84 | reset signal R shaping circuit |
| 85 | reset signal J shaping circuit |
| 86 | slider position detector |
| 87 | card transport motor control circuit |
| 88 | card signal T control circuit |
| 89 | card signal B |
| 100 | card |
| 105 | carriage drive pulley |
| 106 | head transport gear train |
| 107 | head transport transfer gear |
| 107a | tab projection |
| 108 | paper transport gear train |
| 111 | guide frame A |
| 112 | card transport power transmission gear |
| 112a | hole |
| 113 | slider drive gear shaft |
| 114 | power transmission spring |
| 115 | card transport transfer gear |
| 116 | card transport power transmission gear train |
| 118 | card guide |
| 121 | slider A |
| 121a | top gear |
| 121b | other gears |
| 121c | fixed holding members |
| 121d | card stop |
| 121e | rack |
| 122 | slider drive spring |
| 123 | slider drive ratchet |
| 123a | claw |
| 124 | slider drive gear 1 |
| 124a | gear |
| 124b | CAM |
| 124c | gear |
| 125 | card transport electromagnet |
| 126 | slider drive trigger plate 1 |
| 127 | attraction leaf spring |
| 128 | slider return spring A |
| 129 | slider return spring B |
| 131 | card holder lever A |
| 131a | arm |
| 131b | arm |
| 131c | detection lever |
| 132 | card presser spring A |
| 133 | card presser rubbers A |
| 141 | card holder lever position detector |
| 141a | lever |
| 150 | card transport mechanism |
| 151 | motor drive signal |
| 152 | timing signal |
| 153 | reset signal R |
| 154 | print area |
| 155 | card feed signal |
| 156 | card signal B |
| 157 | card holder lever position detector signal |
| 158 | card signal T |
| 171 | printer assembly A |
| 180 | cardholder lever position detector shaping circuit |
| 181 | card transport coil control circuit |
| 200 | card transport power transmission assembly |
| 201 | card transport assembly |
| 202 | card presser or holder assembly |
| 203 | card transport assembly |
| 301 | card transport roller |
| 302 | card presser plunger |
| 303 | card holder lever |
| 303a | pivot |
| 304 | card presser roller |
| 305 | spring |
| 306 | card stop |
| 321 | card presser plunger |
| 321a | spring |
| 322 | card presser roller |
| 323 | card transport roller |
| 324 | roller |
| 325 | timing belt |
| 326 | roller |
| 327 | card transport cachet wheel |

-continued

| Reference Numerals | |
|---|---|
| 328 | card transport claw |
| 329 | card transport |
| 329a | card transport channel |
| 330 | card transport electromagnet |
| 331 | card transport trigger lever |
| 332 | card transport spring |
| 349 | tensioning roller |
| 350 | card transport transmission |
| 500 | printer control circuit |
| 700 | transmission meaning |
| 701 | card transport power transmission assembly |
| 702 | card transport assembly |
| 704 | card presser or holder |
| 705 | card holder lever position detector assembly |
| 707 | clutch mechanism |
| 708 | rack |

What is claimed is:

1. A printing apparatus for printing on a card-like medium having one edge, comprising:

printing means for printing on the card-like medium, having means for moving said printing means in a direction perpendicular to the relative movement of the card-like medium;

a slider having a card stop against which the one edge of the card-like medium stops;

holding means for selectively holding and releasing the card-like medium to and from said slider;

a guide frame having at least one guide portion engaged with said slider for reciprocating said slider parallel to said guide frame; and transport drive means for commonly supplying drive power to said slider for moving said slider along said guide member for printing by said printing means and to said holding means for selectively holding and releasing the card-like medium.

2. A printer according to claim 1, wherein said slider comprises a card holding lever rotatably mounted thereon, and wherein said holding means comprises a first holding member positioned on said slider and a second moving holding member arranged on said card holding lever.

3. A printer according to claim 2, further comprising detector means for detecting a predetermined position of said slider, wherein said transport drive means comprises a stepping motor, a timing belt coupled to said transport drive means and arranged in the direction of movement of said slider, and a card transport drive pin fixedly secured to said timing belt for engagement with said card holder lever to move said slider by means of the card holder lever.

4. A printer according to claim 3, wherein said guide frame comprises a stop for restricting a range of movement of said slider so that after movement of said slider has been stopped by said stop, said card holder lever is turned by said card transport drive pin to place said second holding member in an open position.

5. A printer according to claim 3, further comprising a slider presser lever, wherein said guide frame comprises a guide member and arranged substantially parallel to a direction of movement of said slider, wherein said slider comprises an engaging member for movement along said guide member, wherein said slider presser lever is pressed against said engaging member to said guide member across a range of movement of said slider so that said card stop can be maintained approximately perpendicular to the direction of movement of said slider.

6. A printer according to claim 1 wherein said transport drive means comprises a gear assembly having a rack arranged on said slider and gears engaged with said rack and rotatable in only one direction, and a spring for urging said slider in a predetermined direction, wherein after said slider is driven by said gears from a first position to a second position, said slider is returned to the first position by said spring.

7. A printer according to claim 6, further comprising:

a clutch gear, drive shaft coupled to said transport drive means, a clutch spring having a first one end is engaged with the clutch gear and a second other end is engaged with said gear assembly, and a trigger magnet having an operating plate for engaging with the clutch gear to stop the rotation of said gear assembly, wherein said gear assembly is controlled by said clutch gear positioned so as to be rotatable in response to said drive shaft.

8. A printer according to claim 7, further comprising a cam provided on said gear assembly so as to be contactable with said card holder lever, wherein said holding means is controllable to be opened and closed by rotating said gear assembly in one direction.

9. A printer according to claim 6, further comprising a guide member composed of a flexible member having a first end fixed to said guide frame and a second end positioned between said slider and said guide frame, wherein said flexible member opens and closes corresponding to movement of said slider, and wherein when said slider is positioned at a farthest point from said print means, said second end opens to guide the card paper.

10. A card transport mechanism for transporting a card-like output medium having a bottom edge for being fixed in a printer which includes printing means having means for transporting said printing means perpendicular to the relative movement of the card-like output medium, comprising:

a slider having a card stop against which the bottom edge of the card-like medium stops;

holding means for selectively holding and releasing the card-like medium to said slider;

a guide frame having at least one guide portion engaged with said slider for moving said slider parallel to said guide frame; and transport drive means for commonly supplying drive power to said slider for reciprocating along said guide member and to said holding means for selectively holding and releasing said card-like medium.

11. A card transport mechanism according to claim 10, wherein said slider comprises a card holding lever rotatably mounted thereon, wherein said holding means comprises a first holding member positioned on said guide frame, and a second moving holding member arranged on said card holding lever.

12. A card transport mechanism according to claim 11, further comprising detector means for detecting a predetermined position of said slider, wherein said transport drive means comprises a stepping motor, a timing belt coupled to said transport drive means and arranged in the direction of movement of said slider, and a card transport drive pin fixedly secured to said timing belt for engagement with said card holder lever to move said slider by means of the card holder lever.

13. A card transport mechanism according to claim 12, wherein said guide frame comprises a stop for restricting a range of movement of said slider so that after movement of said slider has been stopped by said stop, said card holder lever is turned by said card transport drive pin to place said second holding member in an open position.

14. A card transport mechanism according to claim 12, further comprising a slider presser lever, wherein said guide frame comprises a guide member and arranged substantially parallel to a direction of movement of said slider, wherein said slider comprises an engaging member for movement along said guide member, wherein said slider presser lever is pressed against said engaging member to said guide member across a range of movement of said slider so that said card stop can be maintained approximately perpendicular to the direction of movement of said slider.

15. A card transport mechanism according to claim 10, wherein said transport drive means comprises:

a gear assembly having a rack arranged on said slider and gears engaged with said rack and rotatable in only one direction, and a spring for urging said slider in a predetermined direction, wherein after said slider is driven by said gears to a from a first position to a second position, said slider is returned to the first position by said spring.

16. A card transport mechanism according to claim 15, further comprising:

a clutch gear, drive shaft coupled to said transport drive means, a clutch spring having a first end is engaged with the clutch gear and a second end is engaged with said gear assembly, and a trigger magnet having an operating plate for engaging with the clutch gear to stop the rotation of said gear assembly, wherein said gear assembly is controlled by said clutch gear positioned so as to be rotatable in response to said drive shaft.

17. A card transport mechanism according to claim 16, further comprising a cam provided on said gear assembly so as to be contactable with said card holder lever, wherein said holding means is controllable to be opened and closed by rotating said gear assembly in one direction.

18. A card transport mechanism according to claim 15, further comprising a guide member composed of a flexible member having a first end fixed to said guide frame and a second end positioned between said slider and said guide frame, wherein said flexible member opens and closes corresponding to movement of said slider, and wherein when said slider is positioned at a farthest point from the printer, said second end opens to guide the card paper.

19. A method for transporting a card-like output medium in a printer having a printing element comprising the steps of:

providing a slider having a holding assembly, said holding assembly being movable between an open position and a closed position;

inserting the card-like medium into a slider having a holding assembly in the open position so that one edge of the card-like medium abuts the slider;

holding the card-like medium secured to the slider by closing the holding assembly:

releasing the card-like medium from the slider by opening the holding assembly;

moving the slider so that the card-like medium opposes the printing element for printing a line of data;

transporting the printing element perpendicular to the movement of the card-like medium; and supplying from a common drive source drive power for said holding, releasing and moving steps.

20. A printing apparatus for printing on a card-like medium having one edge, comprising:

printing means for printing on the card-like medium;

a slider having a card stop against which the one edge of the card-like medium stops;

holding means for holding the card-like medium to said slider;

a guide frame having at least one guide portion engaged with said slider for moving said slider parallel to said guide frame;

transport drive means for moving said slider along said guide member for printing by said printing means, wherein said slider comprises a card holding lever rotatably mounted thereon, wherein said holding means comprises a first holding member positioned on said slider and a second moving holding member arranged on said card holding lever; and detector means for detecting a predetermined position of said slider, wherein said transport drive means comprises a stepping motor, a timing belt coupled to said transport drive means and arranged in the direction of movement of said slider, and a card transport drive pin fixedly secured to said timing belt for engagement with said card holder lever to move said slider by means of the card holder lever.

21. A printer according to claim 20, wherein said guide frame comprises a stop for restricting a range of movement of said slider so that after movement of said slider has been stopped by said stop, said card holder lever is turned by said card transport drive pin to place said second holding member in an open position.

22. A printer according to claim 20, further comprising a slider presser lever, wherein said guide frame comprises a guide member and arranged substantially parallel to a direction of movement of said slider, wherein said slider comprises an engaging member for movement along said guide member, wherein said slider presser lever is pressed against said engaging member to said guide member across a range of movement of said slider so that said card stop can be maintained approximately perpendicular to the direction of movement of said slider.

23. A printing apparatus for printing on a card-like medium having one edge, comprising;

printing means for printing on the card-like medium;

a slider having a card stop against which the one edge of the card-like medium stops;

holding means for holding the card-like medium to said slider;

a guide frame having at least one guide portion engaged with said slider for moving said slider parallel to said guide frame; and transport drive means for moving said slider along said guide member for printing by said printing means, wherein said transport drive means comprises:

a gear assembly having a rack arranged on said slider and gears engaged with said rack and rotatable in only one direction, and a spring for urging said slider in a predetermined direction, wherein after said slider is driven by said gears from a first position to a second position, said slider is returned to the first position by said spring.

24. A printer according to claim 23, further comprising:

a clutch gear, drive shaft coupled to said transport drive means, a clutch spring having a first one end is engaged with the clutch gear and a second other end is engaged with said gear assembly, and a trigger magnet having an operating plate for engaging with the clutch gear to stop the rotation of said gear assembly, wherein said gear assembly is controlled by said clutch gear positioned so as to be rotatable in response to said drive shaft.

25. A printer according to claim 24, further comprising a cam provided on said gear assembly so as to be contactable with said card holder lever, wherein said holding means is controllable to be opened and closed by rotating said gear assembly in one direction.

26. A printer according to claim 23, further comprising a guide member composed of a flexible member having a first end fixed to said guide frame and a second end positioned between said slider and said guide frame, wherein said flexible member opens and closes corresponding to movement of said slider, and wherein when said slider is positioned at a farthest point from said print means, said second end opens to guide the card paper.

27. A card transport mechanism for transporting a card-like output medium having a bottom edge in a printer, comprising:

a slider having a card stop against which the bottom edge of the card-like medium stops;

holding means for holding the cord-like medium to said slider;

a guide frame having at least one guide portion engaged with said slider for moving said slider parallel to said guide frame;

transport drive means for moving said slider along said guide member, wherein said slider comprises a card holding lever rotatably mounted thereon, wherein said holding means comprises a first holding member positioned on said guide frame, and a second moving holding member arranged on said card holding lever; and detector means for detecting a predetermined position of said slider, wherein said transport drive means comprises a stepping motor, a timing belt coupled to said transport drive means and arranged in the direction of movement of said slider, and a card transport drive pin fixedly secured to said timing belt for engagement with said card holder lever to move said slider by means of the card holder lever.

28. A card transport mechanism according to claim 27, wherein said guide frame comprises a stop for restricting a range of movement of said slider so that after movement of said slider has been stopped by said stop, said card holder lever is turned by said card transport drive pin to place said second holding member in an open position.

29. A card transport mechanism according to claim 27, further comprising a slider presser lever, wherein said guide frame comprises a guide member and arranged substantially parallel to a direction of movement of said slider, wherein said slider comprises an engaging member for movement along said guide member, wherein said slider presser lever is pressed against said engaging member to said guide member across a range of movement of said slider so that said card stop can be maintained approximately perpendicular to the direction of movement of said slider.

30. A card transport mechanism for transporting a card-like output medium having a bottom edge in a printer, comprising:

a slider having a card stop against which the bottom edge of the card-like medium stops;

holding means for holding the card-like medium to said slider;

a guide frame having at least one guide portion engaged with said slider for moving said slider parallel to said guide frame; and transport drive means for moving said slider along said guide member, wherein said transport drive means comprises:

a gear assembly having a rack arranged on said slider and gears engaged with said rack and rotatable in only one direction, and a spring for urging said slider in a predetermined direction, wherein after said slider is driven by said gears to a from a first position to a second position, said slider is returned to the first position by said spring.

31. A card transport mechanism according to claim 30, further comprising:

a clutch gear, drive shaft coupled to said transport drive means, a clutch spring having a first end is engaged with the clutch gear and a second end is engaged with said gear assembly, and a trigger magnet having an operating plate for engaging with the clutch gear to stop the rotation of said gear assembly, wherein said gear assembly is controlled by said clutch gear positioned so as to be rotatable in response to said drive shaft.

32. A card transport mechanism according to claim 31, further comprising a cam provided on said gear assembly so as to be contactable with said card holder lever, wherein said holding means is controllable to be opened and closed by rotating said gear assembly in one direction.

33. A card transport mechanism according to claim 30, further comprising a guide member composed of a flexible member having a first end fixed to said guide frame and a second end positioned between said slider and said guide frame, wherein said flexible member opens and closes corresponding to movement of said slider, and wherein when said slider is positioned at a farthest point from the printer, said second end opens to guide the card paper.

* * * * *

UNITED STATES PATENT AND TRADEMARK OFFICE

CERTIFICATE OF CORRECTION

| | | |
|---|---|---|
| PATENT NO. | : | 5,468,079 |
| DATED | : | November 21, 1995 |
| INVENTOR(S) | : | Murakoshi, et al. |

It is certified that an error appears in the above identified patent and that said Letters Patent is hereby corrected as shown below:

Column 26, line 62, change "cord-like" to --card-like--.

Signed and Sealed this

Twenty-first Day of January, 1997

*Attest:*

Bruce Lehman

BRUCE LEHMAN

*Attesting Officer*

*Commissioner of Patents and Trademarks*